United States Patent [19]

Murase et al.

[11] 3,955,906

[45] May 11, 1976

[54] SYSTEM FOR TRANSPORTING A FILAMENT- BUNDLE FROM A SPINNING PROCESS TO A SUCCESSIVE DRAWING PROCESS

[75] Inventors: Yasuhiro Murase, Matsuyama; Mitsuji Ito, Kawanishi; Nobuharu Izawa, Ehime; Masahiro Matsui, Matsuyama, all of Japan

[73] Assignee: Teijin Limited, Osaka, Japan

[22] Filed: Aug. 19, 1974

[21] Appl. No.: 498,296

[30] Foreign Application Priority Data

| | | |
|---|---|---|
| Aug. 22, 1973 | Japan | 48-93256 |
| Aug. 22, 1973 | Japan | 48-93257 |
| Aug. 22, 1973 | Japan | 48-97539[U] |
| Aug. 23, 1973 | Japan | 48-93817 |

[52] U.S. Cl. ..... 425/88; 57/1 R; 57/36; 425/455 F

[51] Int. Cl.[2] ..... D01D 7/00

[58] Field of Search ..... 425/88, 455 F; 57/1 R, 57/156, 34 R, 36, 55; 214/16 B; 104/48

[56] References Cited

UNITED STATES PATENTS 3,724,979 4/1973 Maringer et al. ..... 425/88

*Primary Examiner*—Robert D. Baldwin

*Attorney, Agent, or Firm*—Burgess, Ryan and Wayne

[57] ABSTRACT

Method and system for transporting a filament-bundle from a spinning process to a successive drawing process in a factory of producing synthetic filament yarns. The filament bundle is transported by means of can-transportation system between two desired positions along a fixed carrying passage automatically. Full packaged cans filled with the filament bundle are transported along the fixed carrying passage by a carrying means from a receiving position below a delivery mechanism of a spinning equipment to a creeling passage adjacent to a creel of a drawing equipment, and empty cans are carried from the creeling passage to a reserving position along a fixed passage for the carrying means and thereafter carried to the above-mentioned receiving position one by one. The motion of the carrying means is controlled by a control means involving a control computer.

3 Claims, 40 Drawing Figures

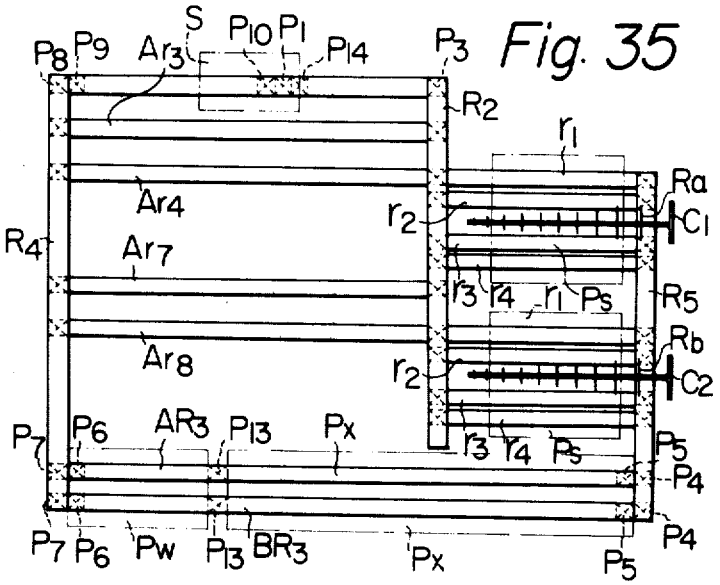
Fig. 35
Fig. 36
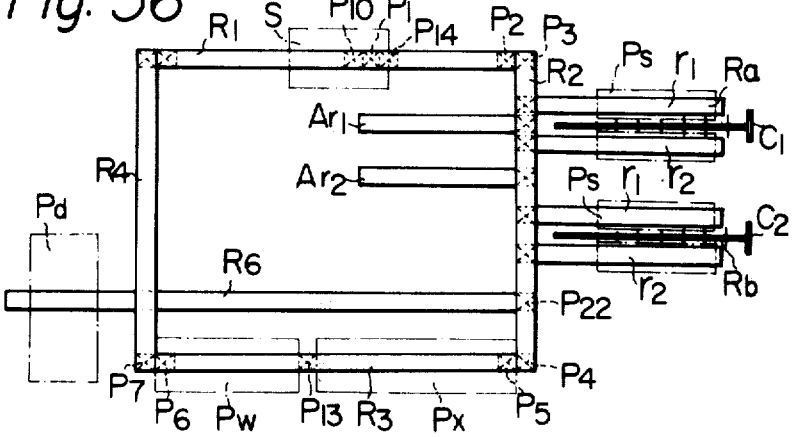

SYSTEM FOR TRANSPORTING A FILAMENT-BUNDLE FROM A SPINNING PROCESS TO A SUCCESSIVE DRAWING PROCESS

SUMMARY OF THE INVENTION

The present invention relates to a system for transporting a filament-bundle from a spinning process to a successive drawing process in a factory producing synthetic filament yarns.

In a factory producing synthetic filament yarns, a plurality of continuous multifilaments melt-spun from the respective spinnerets are grouped as a bundle of undrawn multifilaments by means of a collecting guide roller. The bundle of undrawn multifilaments is taken up by the set of capstan rollers and, then delivered from a pair of delivery rollers into a can by way of a guide pipe or ejector which is continuously swinging. When the above-mentioned can is filled with the bundle of undrawn multifilaments, the can filled with the undrawn filament is doffed from the receiving position of the can and an empty can is positioned at the above-mentioned receiving position. The above-mentioned can filled with the undrawn filament is hereinafter referred to as a full packaged can. Next, the full packaged cans are transported to a place for reserving them by a carrier which is manually driven. When it is required to supply the above-mentioned undrawn multifilaments to a drawing equipment, the full packaged cans which have been reserved at the reserving position, are carried to a creel portion of the drawing equipment one by one. Then a bundle of drawn multifilaments is introduced from each can so as to creel them, and a plurality of such bundles of undrawn multifilaments delivered from a predetermined number of full packaged cans are fed to the drawing equipment. In generally, the above-mentioned supplying of the bundle of undrawn multifilaments into a can is carried out in such a processing condition that the total thickness of the bundle of multifilaments is in a range between 20 thousands deniers and 2 million deniers, and the processing speed is in a range between 300 and 2,000 meters/minute. However the abovementioned drawing operation is carried out with a plurality of bundles of undrawn multifilaments which has a total thickness between a half million deniers and 10 million deniers and the supplying speed is in a range between 50 and 300 meters/minute which is relatively slow in comparison with the delivery speed of the spinning operation. Therefore, consideration must be given to the time difference between the time required to produce a full packaged can and the time required to consume the material filaments in a full packaged can in the drawing process, so as to establish an effective transporting method of the bundles of undrawn multifilaments from the spinning process to a successive drawing process. In the conventional method for transporting filament-bundle from a spinning process to a successive drawing process, when the above-mentioned full packaged cans become empty, these empty cans are carried by a carrier from the creel to a place for reserving them one by one and, thereafter, a plurality of full packaged cans are carried to the creel of the drawing equipment and the above-mentioned creeling operation is carried out. In addition, the empty cans are carried from the reserving placed to the receiving position below the delivery rollers of the spinning equipment successively.

According to our experience, we have found that the above-mentioned conventional system of transporting cans involves several drawbacks. That is, in the above-mentioned conventional system, the can transporting operation and the creeling operation are mainly carried out non automatically so that the manual labor costs involved are high. Further even if efforts are made to concentrate the manual operations so as to increase the working efficiency, since the creeling operation require at least one hour and the drawing equipment cannot be driven during the creeling operation, the machine use efficiency of the drawing equipment is doubtless lowered. Moreover, since the cans are transported by a carrier which is driven by a worker, a sufficient number of cans and large spaces for reserving the cans are required to carry out the operation smoothly. Lately there has been increasing interest in adopting the so-called large package system in order to increase the working efficiency of the equipment, however, efficient adoption of the large package system is restricted by the above-mentioned inherent defects the conventional system.

It is well known that a fork-lift has been utilized to carry the cans. However, if the size of the can and the weight of the full packaged can are very large, the following problems are also generated. That is, a larger space than for smaller cans is required for carrying out the loading and unloading operation of the fork-lift. Further, during the driving of the fork-lift, the large cans obstruct the view of the driver along the carrying passage of the fork-lift so that there is a certain possibility of injuring mill workers.

The principal object of the present invention is to eliminate the above-mentioned drawbacks by introducing a unique method and system for transporting filament-bundles from a spinning process to a successive drawing process, wherein full packaged cans and empty cans are transported between two desired places along a particular passage or passages by automatic carrying means.

According to the present invention, the above-mentioned particular passage comprises a closed-loop passage and at least one passage branching from the closed-loop passage. The closed-loop passage is composed of a first main passage formed below the delivery part of the spinning equipment and a second main passage formed at a position separate from the disposition of the first main passage. The closed loop passage further has a first transversal passage connected to an end of the first main passage and an end of the second main passage and a second transversal passage connected to the other ends of the first and second main passages. The above-mentioned branched passage is branched from the first transversal passage and extends along a horizontal creel of a drawing equipment at both sides of the creel and terminates at a root part of the creel. It is also useful to apply at least one auxiliary branch passage branching from the above-mentioned first transversal passage so as to form a position for reserving full packaged cans.

According to the present invention, means for carrying full packaged cans or empty cans comprises in combination a first carrier which is capable of positioning a can or a pair of cans at any desirable location along the above-mentioned second main passage, a third carrier which is capable of transferring each full packaged can from a reserve position along the above-mentioned first main passage to above-mentioned first transversal passage, and then transferring it to either one of the above-mentioned branched passages extending along the horizontal creels of the drawing equipment and is also capable of transferring empty cans from the above-mentioned branch passage to the second main passage via the first transversal passage, and a fourth carrier having a construction similar to the third carrier applied to the first transversal passage.

Actually, at least two drawing equipments are utilized for one piece of spinning equipment and therefore, at least two branched passages are preferably required to arrange the full packaged cans along the creels of the drawing equipments. Consequently, for the sake of better understanding of the present invention, the following explanation is directed to the machine installation provided with more than two branched passages extending along the creels of the drawing equipments. The motion of the above-mentioned different four carriers is remote controlled by an automatic control means and a plurality limit switches, relays and devices for detecting the existence of a can at a particular position on the above-mentioned passages.

In a preferred embodiment of the present invention, each horizontal creel of a drawing equipment is accompanied by two lines of branched passages extended therealong. Consequently a plurality of full packaged cans can be carried to the respective positions on one of the above-mentioned branched passages during the operation wherein a plurality of bundles of filaments are fed to the drawing equipment from respective cans positioned along the other branched passages. Therefore, any excessive time loss due to a time for carrying the full packaged cans to a branched passage for creeling the bundles of filaments can be eliminated.

In a particular embodiment of the present invention wherein a single branched passage is utilized for supplying the material to the drawing equipment, the full packaged cans are reserved at a reserving position along other passage, for example, an auxiliary passage branching from the first transversal passage at a position near the above-mentioned single passage, so that the time required to change the exhausted cans to the full packaged cans can be also reduced remarkably.

In the present invention, the can's transporting operation is carried out automatically and, therefore, the inherent defects of the conventional system are eliminated remarkably.

BRIEF EXPLANATION OF THE DRAWINGS

FIGS. 30, 31, 32, 33, 34, 35 and 36 are schematic plan views of several modified transportation systems according to the present invention.

DETAILED EXPLANATION OF THE INVENTION

General Explanation of the Transporting Method

Figure 1:
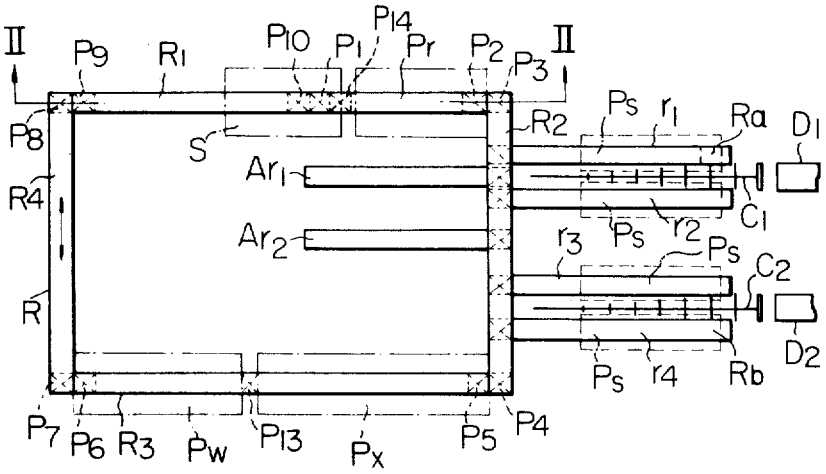
FIG. 1 is a schematic plan view of a transportation passage for carrying cans according to the present invention.

For the sake of easy understanding of the present invention, a first embodiment which satisfies the basic requirement of the present invention is first explained in detail.

In the first embodiment shown in FIGS. 1, 2 and 3, a spinning equipment is disposed on a second floor B and a drawing equipment is disposed on a first floor A below the second floor B. A plurality of continuous multifilament yarns are melt-spun from the respective spinnerets (not shown) and then the multifilament yarns are cooled by means of the respective cooling devices 1 so as to the solidified. The above-mentioned plurality of solidified multifilament yarns are fed to a collecting guide roller 3 via respective rollers 2 for changing the carrying direction thereof and, thereafter the collected yarns in the form of bundle-filaments are taken up by means of a set of capstan rollers 4, and fed to a pair of nip rollers 6 by way of a guide roller 5. Each nip roller 6 is provided with an axially grooved peripheral surface to enable stable gripping of the bundle of multifilaments Y. The bundle of filaments Y, which is continuously delivered from the nip rollers 6, is supplied into a can 8 after passing through a guide tube 7. The thickness of the above-mentioned bundle of filaments Y is normally in a range between 20,000 denier and 2,000,000 denier, for example, 360,000 denier, and the delivery speed of the nip rollers 6 is normally in a range between 300 meters/minute and 2,000 meters/-minute, for example 1,000 meters/minute in this embodiment. To deposit the bundle of filaments Y in the can 8 uniformly, the guide tube 7 is preferably swung in a transversal direction to and along the first main passage of the cans 8.

In this embodiment, the size of the cans 8, which have a square transversal cross section, is 2.0 m × 2.0 m × 2.0 m.

The can 8 is positioned at a receiving position just below an outlet of the guide tube 7 to receive the bundle of filaments Y. The carrying passage of the cans 8 is formed on the first floor and comprises a closed passage $\overline{R}$ and at least two parallel passages Ra branched from the closed passage $\overline{R}$ as shown in FIG. 1. The closed passage $\overline{R}$ comprises a first main passage $R_1$, formed at a position below the spinning equipment S, a first transversal passage $R_2$, connected at its upstream terminal $P_3$ to a downstream terminal $P_2$ of the first main passage $R_1$; a second main passage $R_3$, connected its upstream terminal $P_5$ with a downstream terminal $P_4$ of the first transversal passage $R_2$; a second transversal passage $R_4$, connected its upstream terminal $P_7$ and downstream terminal $P_8$ with a downstream terminal $P_6$ of the second main passage $R_3$ and an upstream terminal $P_9$ of the first main passage $R_1$, respectively. In this embodiment, two pairs of branched passages Ra and Rb branch from the first transversal passage $R_2$. The branched passage Ra comprises a pair of creel passages r1 and r2 branching from the first transversal passage $R_2$, and they are extended along a horizontal creel $C_1$ of a first drawing equipment $D_1$ in parallel condition. The other branched passage Rb comprises a pair of creel passages *r3* and *r4*, having a structure similar to the above-mentioned passages *r1* and *r2*. These creel passages *r3* and *r4* extend along another horizontal creel $C_2$ of a second drawing equipment $D_2$. A pair of auxiliary branched passages $Ar_1$ and $Ar_2$ are provided as shown in FIG. 1. That is, these branched passages $Ar_1$ and $Ar_2$ also branch from the first transversal passage $R_2$ inside the closed passage $\overline{R}$.

The cans 8 filled with undrawn filaments are transported from the position $P_1$ of the first main passage $R_1$ to a reserving position Pr along the passage $R_1$. When it is required to position the full packaged cans 8 at a supply position Ps along the branched passage $\overline{R}$a (or $\overline{R}$b), the cans 8 are transferred from the reserving position Pr to the first transversal passage $R_2$, via the terminals $P_2$ and $P_3$, and thereafter carried to the supply position Ps of one of the creel passages $r_1$, $r_2$, $r_3$ or $R_4$, from where the empty cans 8 have been removed. In this condition, the free end of the bundle of undrawn multifolaments is taken from each of the cans 8 and a predetermined number of bundle filaments are creeled on one of creels of the horizontal creel $C_1$(or $C_2$), so as to previously prepare the creeling operation before feeding the material to the feed mechanism of the drawing equipment $D_1(D_2)$. The selection of one of the creel passages $r_1$, $r_2$, $r_3$ and $r_4$ where the full packaged cans 8 are needed, is carried out according to a predetermined program controlled by a control computer. The detailed explanation of the controlled action by the control computer will be explained later. When the cans 8, deposited at the supply position Ps of the creel passage $r_1(r_2, r_3, r_4)$ become empty because the bundle of undrawn multifilaments having been supplied to the drawing equipment $D_1(D_2)$ the drawing process of the drawing equipment $D_1(D_2)$ is stopped and a plurality of bundles of the multifilaments of the full packaged cans 8 for which the preparation of the creeling operation have been completed and which are positioned at the supply position Ps of the facing-side creel passage $r_1$ or $r_2$, $r_3$ or $r_4$ facing the empty cans, are prepared to lead into the feeding part of the drawing equipment $D_1(D_2)$. On the other hand, the above-mentioned empty cans 8 are carried to the first transversal passage $R_2$ and then carried to the downstream terminal $P_4$ one at a time. Thereafter, the empty cans 8 are transferred to a preparing position Px along the second main passage $R_3$. According to our experience, some of the above-mentioned empty cans 8 carried to the preparing position Px still contain a small length of bundle filaments and consequently, the above-mentioned empty cans 8 are inspected so as to confirm whether any of the bundle-filaments remains therein or not. Whenever a can is found, which contain a small length of bundle filaments, the remains of the bundle filaments are taken from the can 8 manually.

The above-mentioned inspection operation can be carried out by utilizing an automatic suction means. When the above-mentioned inspection operation of the empty cans 8 is completed, a predetermined number of empty cans 8 are displaced to a waiting position Pw along a downstream portion of the second main passage $R_3$. In this first embodiment, it is required to always reserve an empty can 8 at the upstream terminal $P_9$ of the first main passage $R_1$. Further, it is also required to position an empty can 8 is at a position $P_{10}$ adjacent to the position $P_1$. When a can 8 positioned at the position $P_1$ becomes full of the bundle of multifilaments Y, the empty can 8 positioned at the position $P_{10}$ is displaced to the position $P_1$, and the full packaged can 8 is displaced to the reserving position Pr of the first main passage $R_1$. Thereafter a can 8 positioned at the upstream terminal $P_9$ of the passage $R_4$ is carried to the position $P_{10}$. Since the upstream terminal $P_9$ becomes free to accept an empty can 8, the empty can 8 positioned at the downstream position $P_6$ of the waiting position Pw is carried to the position $P_9$ by way of the second transversal passage $R_4$. Thereafter, the empty cans 8 positioned at the above-mentioned waiting position Pw are displaced toward the downstream terminal $P_6$ one by one, and an additional empty can 8 is displaced to the tail part of the waiting position Pw from the preparing position Px.

If a drawing equipment $D_1(D_2)$ is stopped by unexpected trouble, the balance between the production of the undrawn multifilaments and the consumption thereof by the drawing equipments $D_1(D_2)$ is broken. Even in such condition, the spinning operation should be continuously carried out. Consequently, it is necessary to prepare quite a large space for temporarily reserving the excess full packaged cans 8 before they are supplied to the drawing equipment $D_1(D_2)$. The auxiliary passages $Ar_1$ and $Ar_2$ are prepared to temporarily reserve the above-mentioned excess number of full packaged cans 8. The method for temporarily reserving the above-mentioned excess number of full packaged cans 8 is carried out by a sorting operation by the above-mentioned control computer. The detailed illustration of this control action will be explained later.

The First Main Passage and Carrier Utilized in the First Main Passage

Figures 2, 3:
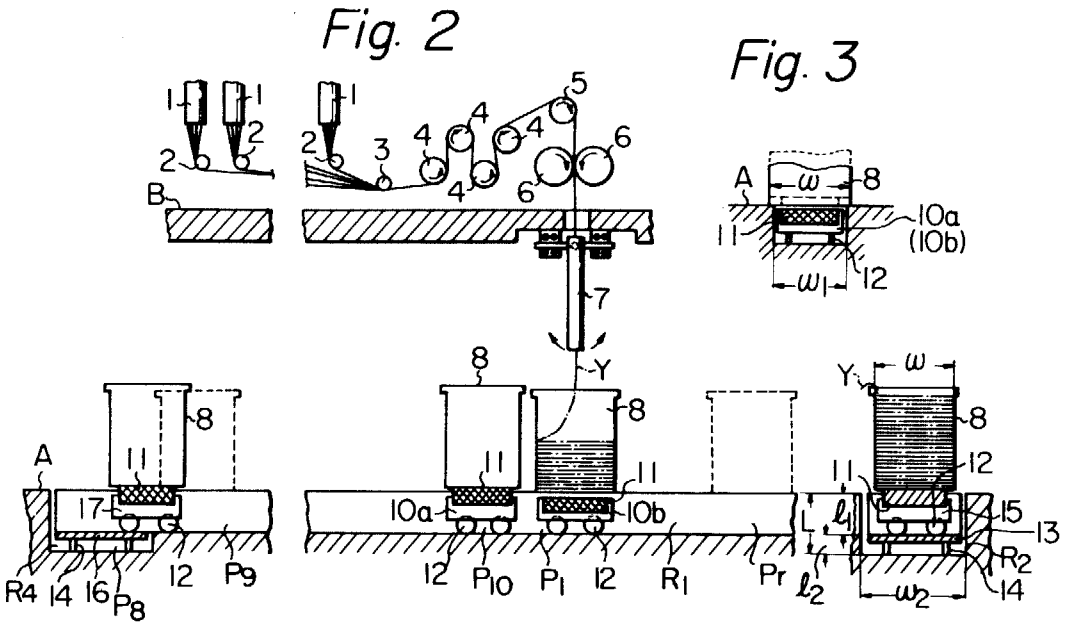
FIG. 2 is a schematic cross sectional view of a main passage of the transporting passage, taken along a line II—II, in FIG. 1, together with a schematic side view of a delivery part of the spinning equipment.
FIG. 3 is a schematic cross sectional view of a main passage of the transportation passage, taken along a line III—III in FIG. 1, together with a schematic cross sectional view of a carrier according to the present invention.

The delivery part of the spinning equipment S, a part of the closed passage $\overline{R}$ and a cross-sectional view of the above-mentioned part of the closed passage $\overline{R}$ taken along a line II—II in FIG. 1 are shown in FIG. 2. As shown In FIG. 2, the passages $R_1$, $R_2$ and $R_4$ are grooved passages formed in the floor of the first floor A. The passage $R_3$ (FIG. 1) has the same structure as the passage $R_1$. In the passage $R_1$, there is provided a pair of carriers 10*a*, 10*b* having an identical construction. A lifting device 11 is mounted on these carriers 10*a*, 10*b*. These carriers 10*a*, 10*b* are also provided with two pairs of wheels 12 so as to be able to proceed along the passage $R_1$. One pair of wheels 12 are mounted on a shaft (not shown) which is driven by a driving mechanism (not shown) mounted on the respective carriers 10*a*, 10*b*. In the first transversal passage $R_2$, there is provided a main carrier 13, and the main carrier 13 is provided with two pairs of wheels 14 so as to be able to proceed along the passage $R_2$. One pair of wheels 14 are driven by a driving mechanism (not shown) mounted on the carrier 13. An auxiliary carrier 15 having a structure identical to the carrier 10*a* (10*b*) is displaceably mounted on the main carrier 13. In the second transversal passage $R_4$, there is also provided a main carrier 16 whereon an auxiliary carrier 17 is displaceably mounted. The structure of the main carrier is identical to the main carrier 13, while the structure of the auxiliary carrier 17 is identical to the axuiliary carrier 15 and, consequently the elements of the carriers 16 and 17 similar to those on carriers 13 and 15 are represented by identical reference numerals to those used for the similar elements of the carriers 13 and 15, respectively.

Figure 5:
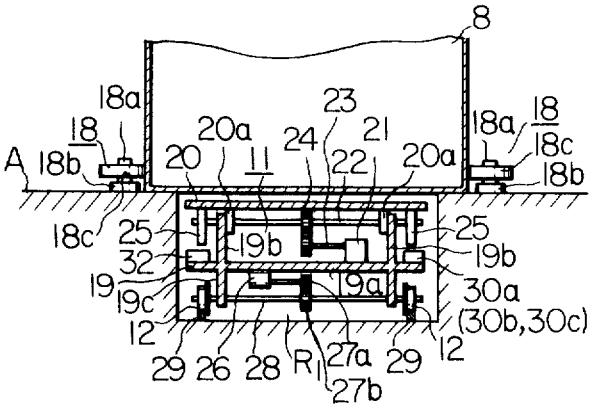
FIG. 5 is a schematic transversal cross section of a carrier utilized for carrying cans along a main passage of the transportation passage shown in FIG. 1.
Figure 6:
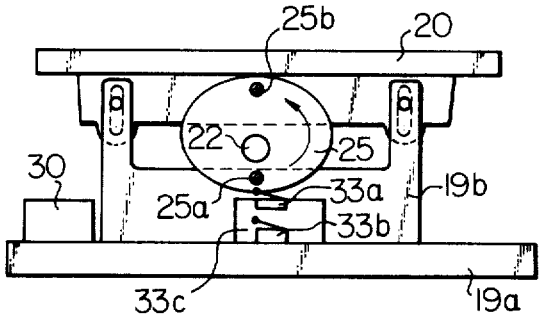
FIG. 6 is a schematic elevational view of a lifting member of the carrier shown in FIG. 5.
Figure 7:
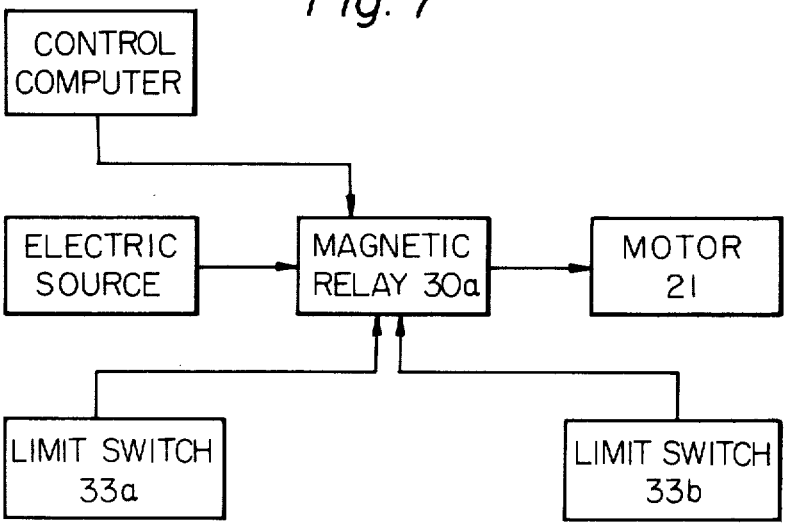
FIG. 7 is a block diagram of an electric circuit for controlling the motion of the lifting member shown in FIGS. 5 and 6.

Referring to FIG. 5, the carrier 10*a* (10*b*) comprises a frame 19, a lifting member 11 mounted on the frame 19 and two pairs of wheels 12 (only one pair of wheels 12 is shown in FIG. 5). The frame 19 comprises a pair of upright brackets 19*b* projecting upward from the horizontal frame 19*a* and a pair of upright brackets 19*c* projecting downward from the horizontal frame 19*a*. The lifting device 11 comprises a driving motor 21, mounted on the horizontal frame 19*a*; a lifting table 20, provided with a pair of upright brackets 20*a* which are slidably supported by the brackets 19*b* in such a way that the lifting table 20 is capable of being displaced upward and downward; a horizontal shaft 22, turnably supported by the brackets 19*b*; a gear 23 mounted on a shaft of the motor 21; a gear 24, rigidly mounted on the horizontal shaft 22 in such a condition that the gear 23 meshes with the gear 24; a pair of eccentric cam plates 25, rigidly mounted on both ends of the shaft 22 in such a condition that the lifting table 20 is always in contact with the cam surface of each eccentric cam plate 25. One of the cam plates 25 is provided with a pair of projections 25*a* and 25*b* projecting from the side wall thereof at positions adjacent to maximum radius and minimum radius cam profile portions as shown in FIG. 6. A pair of limit switches 33*a* and 33*b* are mounted on a bracket 33*c* secured to the frame 19*a* in such a way that the limit switch 33*a* is capable of being actuated by the projection 25*a*, and the limit switch 33*b* is also capable of being actuated by the projection 25*b* when the cam plate 25 is turned. A magnetic relay 30*a* is mounted on the frame 19*a* and the relay 30*a* connects or disconnects the motor 21 with or from the electric source. The magnetic relay 30*a* disconnects the motor 21 from the electric source by the signal issued from the limit switch 33*a* or 33*b*. When the motor 21 is first connected to the electric source by, signal to the magnetic relay 30*a* from a control computer 31 (see FIG. 7), the motor 21 turns the cam plate 25 counterclockwise (in FIG. 6), and when the projection 25*a* actuates the limit switch 33*a*, where the lifting table 20 has been displaced to its uppermost position by the cam plate 25, the magnetic relay 30*a* opens the connection between the electric source and the motor 21 and consequently the motor 21 is stopped so that the lifting table 20 is maintained at its uppermost position. When the control computer 31 then actuates the magnetic relay 30*a* again, the motor 21 is again connected to the electric source so that the cam plates 25 are turned again and, consequently the lifting table 20 is displaced downward, and when the projection 25*b* actuates the limit switch 33*b*, the magnetic relay 30*a* again opens the connection between the motor 21 and the electric source by the signal from the limit switch 33*b* so that the lifting table 20 is positioned at its lowermost position. If the depth of the first main passage $R_1$ is represented by $1_1$ (See FIG. 2), the distance between the above-mentioned uppermost position and the floor of the first main passage $R_1$ is larger than $l_1$, while the distance between the above-mentioned lowermost position and the floor of the first main passage $R_1$ is smaller than $l_1$. The above-mentioned electrical relation between elements is shown in FIG. 7.

Figure 8A:
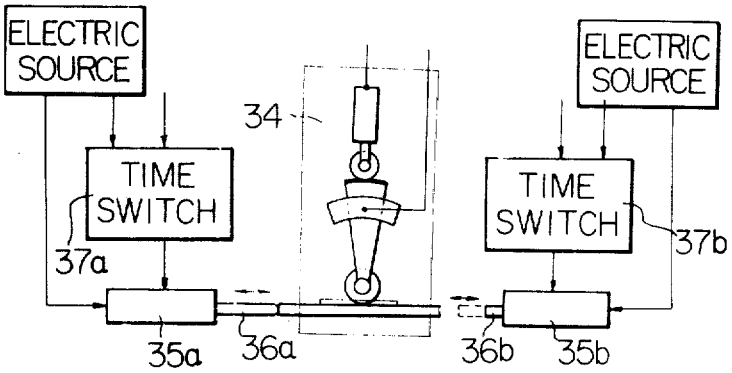
FIG. 8A is a schematic diagram showing a structure of a magnetic relay for controlling the rotation of a motor utilized to drive the carrier shown in FIG. 5.
Figure 8B:
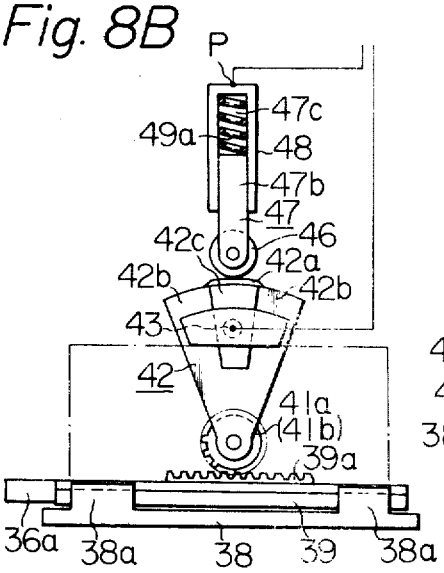
FIGS. 8B and 8C are an elevational view and a side view respectively, of the contact member utilized in the magnetic relay shown in FIG. 8A.
Figure 8C:
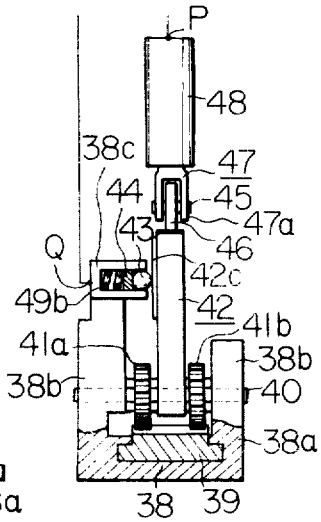

The detailed structure and function of the above-mentioned magnetic relay 30*a* is hereinafter explained with reference to the drawings shown in FIGS. 8A, 8B and 8C. In this embodiment, the magnetic relay 30*a* comprises a contact member 34, and a pair of solenoids 35*a* and 35*b*. The solenoid 35*a* is actuated by a signal issued from the control computer 31 by way of a conventional time switch 37*a*, while the solenoid 35*b* is actuated by signals issued from either one of the limit switches 33*a*, 33*b* by way of a conventional time switch 37*b*. The contact member 34 comprises a main bracket 38, provided with a pair of guide portions 38*a* and a pair of upright brackets 38*b* projecting upwards from the main bracket 38; a horizontal member 39, which is displaceably supported by the guide portions 38*a* and is provided with a rack portion formed thereon; a fan shaped contact 42, which is secured on a shaft 40 turnably supported by the upright brackets 38*b;* another contact 46, which is turnably mounted to a supporting member 47 in such a way that the contact 46 is always urged to the contact surface of the fan shaped contact 42. The supporting member 47 comprises two branched bottom end portions 47*a;* a piston portion 47*b*, having a rectangular transversal cross section; a thin rod portion 47*c*, formed above the piston portion 47*b;* a guide member 48 wherein the piston portion 47*b* is displaceably held; an expansion spring 49*a*, mounted on the thin rod portion 47*c* in the guide member 48 so that the supporting member 47 is always urged toward the fan shaped contact 42. The contact 46 is a metallic roller turnably supported by a shaft 45 which is supported by the above-mentioned two branched bottom end portion 47*a* of the supporting member 47. The fan shaped contact 42 is provided with a portion 42*a* which is made of electro-conductive material and a pair of portions 42*b* which are made of non-electric-conductive material as shown in FIG. 8B. Consequently, the contact surface of the fan shaped contact 42 forms a pair of non-electro-conductive portions 42*b* and an electro-conductive portion 42*a* formed between the above-mentioned portions 42*b*. An electro-conductive piece 42*c* is formed at one side of the fan shaped contact 42 in such a way that the piece 42*c* is always in contact with the portion 42*a*. At a position facing the electro-conductive piece 42, another ball shaped contact 43 is disposed in such a way that contact 43 is turnably supported in a cylinder 38*c* mounted on one of brackets 38*b*. The ball shaped contact 43 is always urged to the piece 42*c* by an expansion spring 49*b* disposed in the cylinder 38*c* in such a way that the spring 49*b* always urges the ball shaped contact 43 to the piece 42*c* by way of a slide piece 44. The shaft 40 is provided with a pair of pinions 41*a*, 41*b* rigidly mounted thereon in such a condition that these pinions 41*a*, 41*b* always mesh with the rack portion 39*a* of the horizontal member 39. Therefore, if the horizontal member 39 is displaced along the main bracket 38, the fan shaped contact 42 is turned so that the contact 46 contacts the electro-conductive portion 42*a*, or the non-electro-conductive portions 42*b* of the fan shaped contact 42. As the supporting member 47, and shaft 45, the piece 42*c*, cylinder 38*c*, spring 49*b*, and slide piece 44 are made of electric conductive material, if the contact 46 rides on the electro-conductive portion 42*a*, the terminal P formed on the supporting member 47 is electrically connected with the terminal Q formed on the cylinder 38*c*. On the other hand, if the contact 46 rides on the non-electro-conductive portion 42*b* of the fan shaped contact 42, the terminal P is disconnected from the terminal Q. The above-mentioned connection and disconnection between the terminals P and Q is created by displacing the horizontal member 39 by urging either of the ends thereof. That is, the solenoid 35*a* provided with a plunger 36*a* is utilized for displacing the horizontal member 39 to a position where the above-mentioned connecting condition is created, while the solenoid 35*b* provided with a plunger 36*b* is utilized for displacing the horizontal member 39 to a position where the above-mentioned disconnecting condition is created. In the above-mentioned embodiment the time switches 37*a* and 37*b* work to actuate the respective solenoids 35*a* and 35*b* so as to displace the horizontal member 39 by way of the respective plungers 36*a* and 36*b* to the above-mentioned desired positions, respectively in such a way that, when either one of the time switches 37*a* and 37*b* receive signals from the control computer 31 or limit switches 33*a*, or 33*b* the connection between the electric source and the solenoid 35*a* (35*b*) is opened after a predetermined time by the action of the respective limit switches 33 *a*, 33*b*.

Accordingly the above-mentioned control action of the motor 21 by the control computer 31 and the limit switches 33*a*, 33*b* can be satisfactorily attained.

Figure 9:
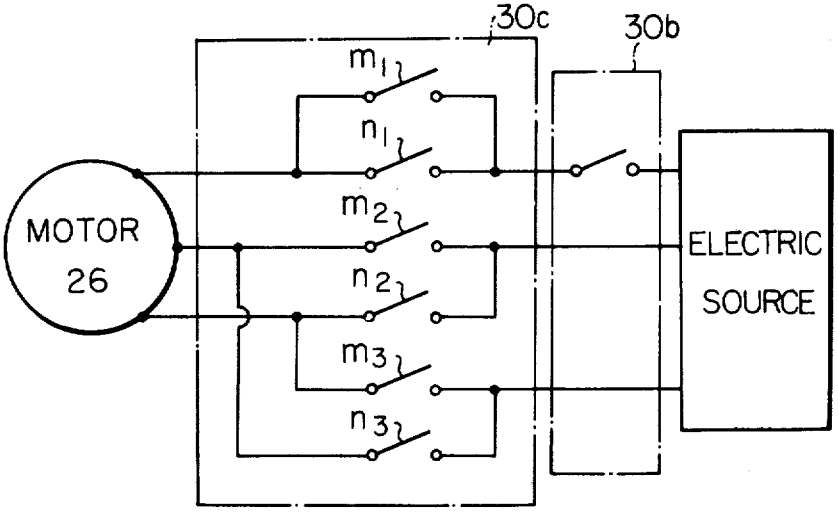
FIG. 9 is an electric circuit of a magnetic relay utilized to change the polarity of the input power of the main motor mounted on the carrier shown in FIG. 5.

A pair of horizontal shafts 38 are turnably mounted on the brackets 19*c*. A reversible motor 26 is mounted on the frame 19*a* as shown in FIG. 5. A reversible magnetic relay 30*c* is mounted on the frame 19*a* so as to change the polarity of the input power to the motor 26. That is, the relay 30*c* connects the motor 26 with alternate polarities of the electric source so as to change the rotational direction of the motor 26. The control computer 31 actuates the reversible magnetic relay 30*c*. The motor 26 is connected to the electric source by way of the reversible magnetic relay 30*c* and a magnetic relay 30*b* having a function similar to the magnetic relay 30*a*, as shown in FIG. 9. The magnetic relay 30*c* is provided with two sets of component relays $m_1$, $m_2$, $m_3$ and $n_1$, $n_2$, $n$ $n_3$, and consequently, the polarity of the input power to the motor 26 can be reversed by changing from the connection of the component relays $m_1$, $m_2$, $m_3$ to the connection of the component relays $n_1$, $n_2$ and $n_3$, and vice versa. One of shafts 28 is provided with a gear 27*b* which meshes with a gear 27*a* rigidly mounted on a shaft of the motor 26. The wheels 12 are rigidly mounted on each end of the shafts 28. Therefore the wheels 12 mounted on the shaft 28 are positively driven by the motor 26. The first main passage $R_1$ is provided with a pair of parallel rails 29 which form a guide for the wheels 12.

The connections of the electric source with the motors 21 and 26 are carried out by utilizing a reeled cord system. In other words, a reeled cord is mounted on an end portion of the first main passage $R_1$ so as to deliver the cord from a reel (not shown) when the carrier 10*a* is displaced away from the reel and, on the other hand, when the carrier 10*a* is displaced toward the reel, the cord is automatically wound on the reel by the action of a spring mounted on the reel. The above-mentioned reeled cord system is popular in the field of electric house-keeping equipment such as electric sweepers.

Therefore, the detailed illustration of the reeled cord system is omitted.

As shown in FIGS. 2, 3 and 5, the first main passage $R_1$ has a transversal width $W_1$ a little narrower than the transversal size W of the can 8 but a little wider than the transversal size of the carriers 10*a*, 10*b*. Therefore, when the lifting member 11 is positioned at its lowermost position, the cans 8 are directly positioned on the first floor A. On the other hand, when the lifting table 11 is positioned at its uppermost position, the cans 8 are supported by the lifting member 11 of the carrier 10*a* or 10*b* and are free from the floor A so that the carrying of the cans 8 by the carrier 10*a* or 10*b* is not disturbed. To prevent any deflection of cans 8 from the carrying passage $R_1$, a plurality of guide members 18 are mounted on both edge portions of the passage $R_1$ in such a condition that a transversal width of a longitudinal straight space between the guide members 18 is slightly larger than the transversal size of the cans 8. Each guide member 18 comprises a bracket 18*b* rigidly mounted on the edge portion of the passage $R_1$, a vertical shaft 18*a* supported by the bracket 18*b* and a horizontal wheel 18 *c* turnably mounted on the shaft 18*a*.

Figure 10:
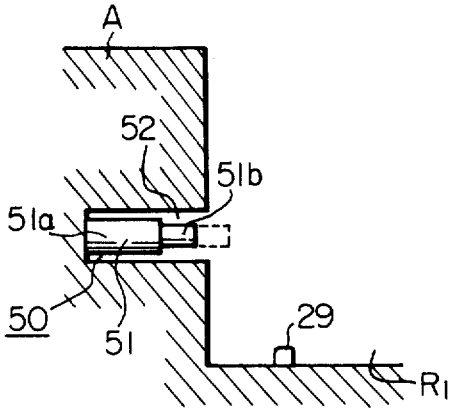
FIG. 10 is a schematic side view of a stopper to control the displacing motion of the carrier shown in FIG. 5.

Referring to FIGS. 1, 2, 3, 5, 6 and 7, during the operation for supplying the bundle of multifilaments Y into a can 8 positioned at $P_1$, an empty can 8 is carried to a position $P_{10}$ by the carrier 10*a*, and at a time before completing the production of a full packaged can 8 at the position $P_1$, the carriers 10*a* and 10*b* are displaced to the positions $P_{10}$ and $P_1$, respectively. The above-mentioned displacements of these carriers 10*a* and 10*b* are actuated by signals issued from the control computer 31. That is, when a predetermined length of a bundle of multifilaments Y has been delivered from the guide tube 7 of the spinning equipment S and the can 8 positioned at $P_1$ is full of the bundle of multifilaments Y, a counter (not shown), which measures the delivered length of the bundle of multifilaments Y, mounted on the spinning equipment S, issues a signal to the control computer 31. A conventional counter such as a hank meter, which is driven by the nip roller 6, is utilized in the present embodiment. Then the control computer 31 first issues a signal to actuate the magnetic relays 30*a* of carriers 10*a* and 10*b*. Consequently, the motors 21 are driven so that the lifting tables 20 of the carriers 10*a*, 10*b* are elevated their uppermost positions. This condition is shown in FIG. 3 by a dotted line. According to the above-mentioned motion of the lifting tables 20, the empty can 8 positioned at $P_{10}$ and the full packaged can 8 positioned at $P_1$ are elevated from the floor A by the respective lifting tables 20. In this condition, the control computer 31 issues a signal to displace the empty can 8 from the position $P_{10}$ to the position $P_1$, and a signal to displace the full packaged can 8 from the position $P_1$ to a position $P_{14}$ adjacently downstream the position $P_1$. According to the above-mentioned signals issued from the control computer 31, the motors 26 of the carriers 10*a* and 10*b* are actuated so that the both carriers 10*a* and 10*b* are displaced to the respective positions $P_1$ and $P_{14}$. To stop the carriers 10*a* and 10*b* at the respective positions $P_1$ and $P_{14}$, stoppers 50 are mounted on a base floor of the passage $R_1$ at positions being capable of actuating the respective limit switches 32 of the carriers 10*a* and 10*b* as shown in FIG. 10. Each stopper 50 comprises a solenoid 51 provided with a plunger 51*b* and mounted in a horizontal aperture 52 formed in a side wall of the passage $R_1$ at the position $P_1$. The carrier 10*a* (10*b*) is provided with the limit switch 32 mounted on the frame 19*a* at a position capable of contacting the plunger 51*b* when the solenoid 51 is actuated by the control computer 31. Another magnetic relay 30*b*, which was described already, is mounted on the frames 19*a* of the carriers 10*a* and 10*b* respectively. Each magnetic relay 30*b* connects the corresponding motor 26 with the electric source by a control signal from the control computer 31 and disconnects it by a signal from the corresponding limit switch 32. As mentioned above, when the limit switch 32 of the carrier 10*a* is actuated by the stopper 50 at the position $P_1$, the magnetic relay 30*b* of the carrier 10*a* opens the connection between the motor 26 thereof and the electric source. To stop the carrier 10*a* at its correct working position, another stopper, which is also actuated by the control computer 31, may be mounted on the side wall of the passage $R_1$ so as to be able to directly contact the frame 19*a* of the carrier 10*a* and prevent further displacement of the carrier 10*a* toward the downward terminal $P_2$ of the passage $R_1$. The carrier 10*b* is stopped at the position $P_{14}$ by the manner similar to the carrier 10*b*.

According to the above-mentioned displacement of carriers 10*a* and 10*b*, the bundle of multifilaments Y is introduced into the empty can 8 mounted on the carrier 10*a*. In this situation the bundle of multifilaments Y connecting the cans 8 on the carriers 10*a* and 10*b* is manually cut.

Figure 11:
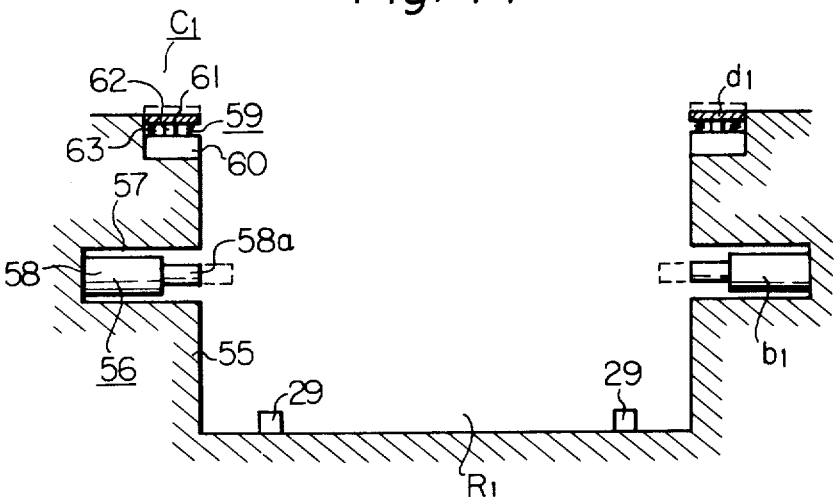
FIG. 11 is a schematic transversal cross sectional view of the cans reserving position formed at the position adjacent to the downstream terminal of the first main passage.
Figure 12:
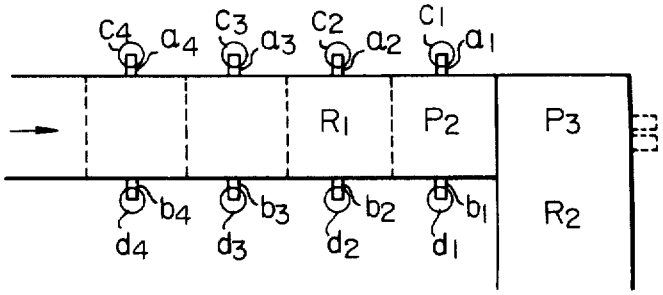
FIG. 12 is a schematic plan view of the cans reserving position shown in FIG. 11, wherein the arrangement of stoppers and detectors are shown.
Figure 13:
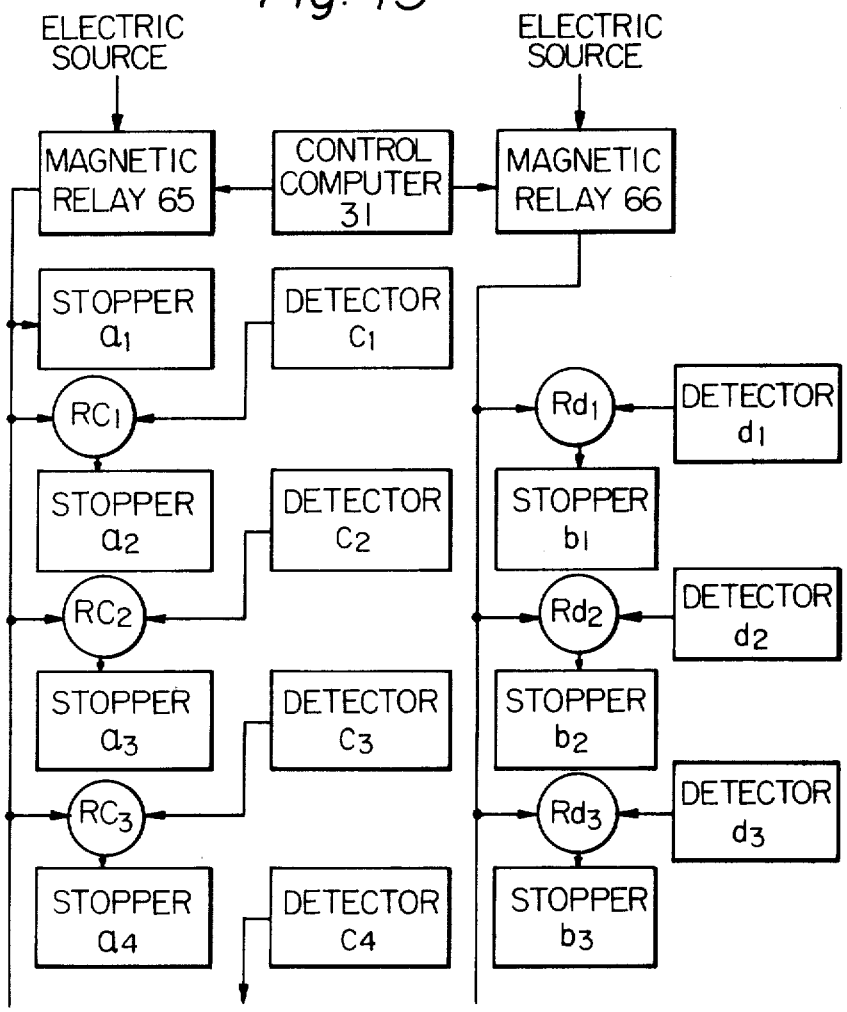
FIG. 13 is a block diagram of a pair of combined control circuits applied to the stoppers and detectors disposed at the reserving position shown in FIG. 12.

When the limit switch 32 of the carrier 10*a* issues a signal, this signal is also transmitted to the control computer 31 and the control computer 31 issues a signal so as to actuate the magnetic relay 30*a*, and accordingly, the motor 21 of the carrier 10*a* is driven. Therefore, the cam plate 25 is turned, that is, the lifting table 20 is displaced to its lowermost position and when the projection 25*b* of the cam plate 25 contacts the limit switch 33*b*, the magnetic relay 30*a* opens the connection between the motor 21 and the electric source. Accordingly, the lifting table 20 of the carrier 10*a* is separated from the can 8 which is positioned at the position $P_1$. This condition is shown in FIG. 3 by a solid line. During the above-mentioned operation of the carrier 10*a*, the control computer 31 issues a signal to actuate the magnetic relay 30*b* of the carrier 10*b*. Therefore, the motor 26 is driven in the normal direction so that the full packaged can 8 supported by the carrier 10*b* is displaced toward the downstream terminal $P_2$ of the passage $R_1$. Referring to FIGS. 11, 12 and 13, a plurality of stoppers 56 are mounted in horizontal apertures 57 formed in the side wall 55 of the first main passage $R_1$ at the reserving position $P_r$ thereof in such a way that a distance between two adjacent apertures 57 is a little larger than the length of the carrier 10*b* along the passage $R_1$. These stoppers are represented by reference numerals $a_1$, $a_2$, $a_3$, $a_4$ - - - . Each stopper 56 comprises a solenoid 58 provided with a plunger 58*a*, and the stopper 56 works with the limit switch 32 of the carrier 10*b* in a way similar to the above-mentioned stopper 50. A plurality of detectors 59 are mounted on edge portions of the passage $R_1$ at positions above the respective stoppers 56. Each detector 59 comprises a limit switch 60 rigidly mounted on a cut-off portion of the edge of the passage $R_1$ and a cover plate 61 which is movably mounted on the limit switch 60 by way of a feeler 62, and a pair of expansion springs 63. The limit switch 6 is mounted in such a way that the cover plate 61 projects upward from the floor surface as shown in FIG. 11 by a dotted line when there is no can 8 on the cover plate 61. Consequently, when a can 8 is disposed on the cover plate 61, the limit switch 60 issues a signal. For the sake of better understanding, these detectors 59 are represented by $c_1$, $c_2$, $c_3$, $c_4$ . . . The actions of these detectors 59 and stoppers 56 are hereinafter illustrated in detail. That is, the stopper $a_1$ which is positioned at $P_2$ is actuated by a signal issued from the control computer 31 by way of a magnetic relay 65. However, the stoppers $a_2$, $a_3$, $a_4$ - - - are actuated by a signal issued from a detector 59 which is mounted in a position above a stopper 56 which is disposed at an adjacent downstream position. In other words, in FIGS. 12 and 13, the stopper $a_2$ is actuated by the detector $c_1$, the stopper $a_3$ is actuated by the detector $c_2$, the stopper $a_4$ is actuated by the detector $c_3$ and so forth. Therefore, when the carrier 10*b* carries a full packaged can 8 from the position $P_1$ to the position $P_2$, the control computer 31 issues a signal to actuate the stopper $a_1$, before the motor 26 is driven in the normal direction. When the carrier 10*b* arrives at the position $P_2$, the stopper $a_1$ actuates the limit switch 32 of the carrier 10*b* so that the carrier 10*b* is stopped at the position $P_2$. The limit switch 32 also issues a signal to the control computer 31, and, then, the control computer 31 issues a signal to actuate the relay 30*a* so that the motor 21 is driven, and consequently the cam plates 25 are turned. According to the above-mentioned motion of the cams 25, when the projection 25*b* contacts the limit switch 33*b*, the relay 30*a* is opened so that the lifting table 20 is positioned at its lowermost position and the carrier 10*b* becomes free from the full packaged can 8 which is now disposed on the edges of the passage $R_1$.

The magnetic relay 65 also works to connect or disconnect the stoppers $a_2$, $a_3$, $a_4$, . . . by way of respective magnetic relays $RC_1$, $RC_2$, $RC_3$, . . . as shown in FIG. 13. These magnetic relays $RC_1$, $RC_2$, $RC_3$ are closed when the detectors $c_1$, $c_2$, $c_3$, . . . are actuated by disposing the can 8 thereon. Therefore, the stopper $a_2$ is actuated when the detector $c_1$ is actuated by disposing the can 8 thereon. Therefore, the stopper $a_2$ is actuated when the detector $c_1$ is actuated, the stopper $a_3$ is actuated when the detector $c_2$ is actuated, the stopper $a_4$ is actuated when the detector $c_3$ is actuated, and so forth. Consequently, when the control computer 31 issues a signal to close the magnetic relay 65, the stopper $a_1$ is actuated. In this condition, the control computer 31 also close the magnetic relay 30*b* while the magnetic relay 30*c* is maintained in a position wherein the motor 26 runs in the normal direction and, the carrier 10*b* moves to the downstream position $P_2$ of the passage $R_1$. When the carrier 10*b* arrives at the position $P_2$, the stopper $a_1$ actuates the limit switch 32 so that the magnetic relay 30*b* is opened. Therefore the carrier 10*b* is stopped at the position $P_2$. The signal of the limit switch 32 is also transmitted to the control computer 31 and the control computer 31 then issues a signal to actuate the magnetic relay 30*a* so as to drive the motor 21. Therefore, the cam plates 25 are turned and the lifting table 20 is displaced downward according to the above-mentioned turning motion of the cam plates 25. And when the projection 25*b* actuates the limit switch 33*b*, the limit switch 33*b* issues a signal to open the magnetic relay 30*a*, so that the motor 21 is stopped and the lifting table 20 is separated from the full packaged can 8. In this condition, the full packaged can 8 is disposed on the floor A so that the detector $c_1$ is actuated. Therefore, the magnetic relay $RC_1$ is actuated to close the connection between the magnetic relay 65 and the stopper $a_2$. However, the limit switch 33*b* issues a signal to the control computer 31 so as to open the magnetic relay 65 simultaneously with the motion of the detector $c_1$, so that the stopper $a_2$ does not work. According to the signal from the limit switch 33*b*, the control computer 31 issues a signal to actuate the magnetic relay 30*c* so as to change the polarity of the connections and also issues a signal to close the magnetic relay 30*b*. As a result, the reversible motor 26 is rotated in reverse direction so that the carrier 10*b* is displaced toward the position $P_1$. At the position $P_1$, a stopper (not shown) having a structure and function similar to the stopper 50 is mounted on an aperture formed in an opposite side wall of the stopper 50. The carrier 10*b* is also provided with a limit switch (not shown) having a structure and function similar to the limit switch 32, which is disposed at a position where the stopper (not shown) can be actuated. When the control computer 31 issues a signal to actuate the magnetic relays 30*b* and 30*c*, the computer 31 also issues a signal to actuate the above-mentioned stopper (not shown). Therefore, when the carrier 10*b* arrives at the position $P_1$, the stopper (not shown) actuates the limit switch (not shown) of the carrier 10*b* so that the magnetic relay 30*b* is opened, that is, the carrier 10*b* is stopped at the position $P_1$ where the can 8 is receiving a bundle of multifilaments Y from the guide tube 7. When a predetermined length of the bundle of multifilaments Y has been delivered from the guide tube 7 of the spinning equipment S and the can 8 positioned at $P_1$ is full of the bundle of multifilaments Y, and consequently the counter (not shown) issues a signal to the control computer 31, the lifting members 11 of the carriers 10*a* and 10*b* are actuated to lift the cans 8 from the surface of the floor A and, thereafter, the carrier 10*a* is displaced to the position $P_1$ as already explained.

Further, the carrier 10*b* is displaced toward the downstream terminal $P_2$ of the passage $R_1$ as already explained. In this condition, the position $P_2$ is occupied with a full packaged can 8, and consequently, when the control computer 31 issues a signal to close the magnetic relay 65, only the stopper $a_2$ is actuated as already explained. Therefore, the carrier 10*b* is stopped at a position corresponding to the stopper $a_2$ and then the lifting member 11 works to position the full packaged can 8 on the floor. Thereafter the carrier 10*b* is returned to the position $P_1$ in a manner similar to that by which the carrier 10*b* is displaced to the position $P_2$ of the passage $R_1$. The successive operation of displacing the carrier 10*b* to the positions corresponding to the stoppers $a_3$, $a_4$, . . . , and return operations of the carrier 10*b* to the position $P_1$, are carried out in a manner similar to the above-mentioned operations related to the stopper $a_2$.

The displacement of the carrier 10*a* is controlled by signals issued from the control computer 31 and stoppers, having a structure and function similar to the stopper 50, disposed on the side walls of the passage $R_1$. That is, an additional pair of stoppers (not shown) are disposed on a side wall of the passage $R_1$ at positions $P_9$ and $P_{10}$. Further a detector having a structure and function similar to the detector 59 is disposed on an edge portion of the passage $R_1$ at position $P_{10}$. This detector (not shown) works with the stopper (not shown) in a manner similar to the detector 59. Therefore, when the carrier 10*a* is displaced to the position $P_1$, after the lifting member 11 of the carrier 10*a* positions the can 8 on the floor, the limit switch 33b issues a signal to the control computer 31 and, then the control computer 31 issues a signal to drive the motor 26 in the reverse direction so that the carrier 10a is displaced to the position $P_9$ and the stopper disposed at the position $P_9$ works with the limit switch 32 of the carrier 10a, so that the carrier 10a is stopped at the position $P_9$. The limit switch 32 of the carrier 10a also issues a signal to the control computer 31. After a predetermined time, the control computer 31 issues a signal to actuate the lifting member 11 of the carrier 10a and, accordingly, the empty can 8 is supported by the lifting table 20 in a condition free from the floor surface, and the limit switch 33a simultaneously issues a signal to stop the rotation of the motor 21, so as to support the can 8 in the above-mentioned condition, and issues a signal to the control computer 31. Accordingly, the control computer 31 issues a signal to drive the motor 26 in the normal running direction as already explained and, therefore, the carrier 10a is displaced to the position $P_{10}$. When the carrier 10a arrives at the position $P_{10}$, the stopper (not shown) stops the carrier 10a and the lifting member positions the empty can 8 on the floor as already explained with regard to the carrier 10b.

Instead of utilizing the above-mentioned stoppers 56 and detector 59, the following mechanism for stopping the carrier 10b at the reserving position Pr can be used except for the stopper identified by *a*. That is, a pair of limit switches (not shown) are mounted on the frame 19 of the carrier 10b at forward and rearward edge positions thereof, respectively, in such a condition that a feeler of each limit switch is capable of contacting a bottom plate of a can 8 which is positioned on the floor A when the carrier 10b approaches the can 8. The above-mentioned limit switches simultaneously issue a signal to actuate the magnetic relay 30b and issue a signal to actuate the magnetic relay 30a.

A Combined Transportation Equipment

A combined transportation equipment comprising a main carrier 13 and an auxiliary carrier 15 is utilized to carry the full packaged cans 8 from the reserving position Pr of the first main passage $R_1$ to the supply position Ps of the branched passage Ra via the first transversal passage $R_2$ and also to carry the empty cans 8 from the supply position Ps to the preparing position Px of the second main passage $R_3$ via the first transversal passage $R_2$.

Figure 14:
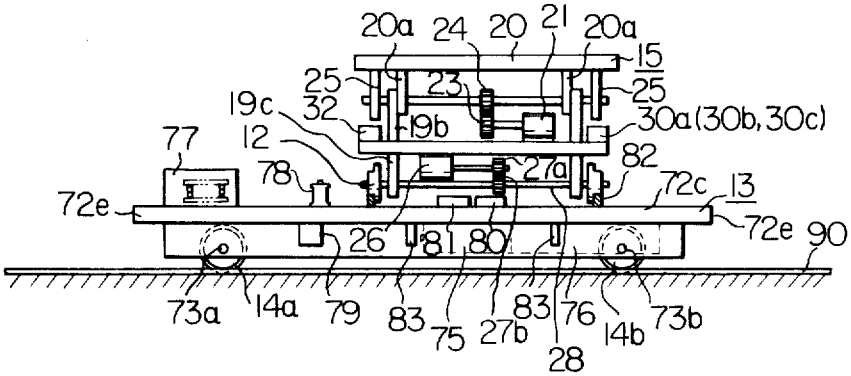
FIGS. 14 and 15 are schematic side and front views, respectively, of a combined transportation carrier utilized to the transversal transportation passage shown in FIG. 1.
Figure 15:
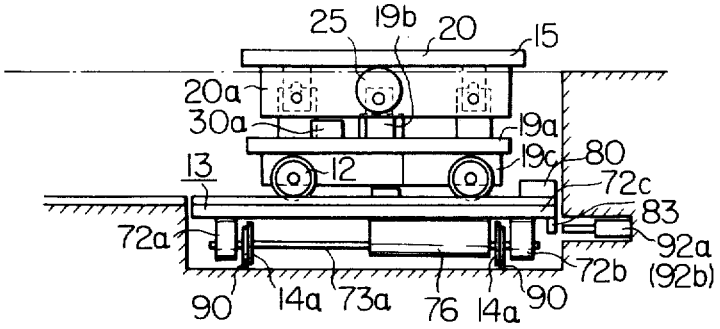

Referring to FIGS. 14 and 15, the main carrier 13 comprises a pair of side frames 72a and 72b projecting downwards from a horizontal base frame 72c at both edge portions thereof in parallel condition, a pair of horizontal shafts 73a and 73b, turnably supported by the side frames 72a and 72b, two pairs of wheels 14a and 14b rigidly mounted on both edge portions of the shafts 73a and 73b, respectively; a reversible motor 75, mounted to the base frame 72c; a mechanism 76, for transmitting power from the motor 75 to the shaft 73b; a reel cord member 77, which holds a cord for driving a motor of the auxiliary carrier 15; a guide member 78, for guiding the reel cord when the auxiliary carrier 15 is driven; a magnetic relay 79, for connecting or disconnecting the connection between the motor 75 and the electric source; a limit switch 80, for actuating the magnetic relay 79, a non-contact type limit switch for detecting arrival of the auxiliary carrier 15 at a predetermined position on the main carrier 13; a pair of rails 82, mounted on the base frame 72c of the main carrier 13 in parallel condition, and; a pair of upright rods 83 projecting downward from the base frame 72c.

The auxiliary carrier 15 has a structure and function quite similar to the carriers 10a and 10b which are explained hereinbefore and, consequently, all elements of the carrier 15 similar to the carrier 10a (10b) are represented by reference numerals identical to those of the carriers 10a, 10b. The only difference between the carrier 15 and the carrier 10a (10b) is the manner of transmitting power for driving the reversible motor 26 and the motor 21 and, also, of transmitting signals between the carrier 15 and the control computer 31. That is, the motion of the carrier 15 is controlled by means of reel cord system provided with the reel cord 77, and, further, the method of stopping the carrier 15 at a predetermined position on the base frame 72c of the main carrier 13 is different from that of carrier 10a (10b). In the transversal passages $R_2$ and $R_4$, a combined transportation equipment is utilized to carry cans 8. To drive the auxiliary carrier 15 along the main passages $R_1$ and $R_3$ and the branched passages $R_a$ and $R_b$, the horizontal base frame 72c of the main carrier should be at the same level as the floor of the main passages $R_1$ and $R_3$ and the branched passages $R_a$ and $R_b$. Consequently, the depth L of the groove of the first and second transversal passages $R_2$ and $R_4$ should be larger than the depth $l_1$ of the first and second main passages $R_1$ and $R_3$ and the branched passages $R_a$ and $R_b$. If the distance between the top surface of the base frame 72c and the floor of the transversal passages $R_2$ and $R_4$ is represented by $l_2$, L can be represented by $(l_1 + l_2)$. Further the width $W_2$ of these transversal passages $R_2$ and $R_4$ is larger than the width W of the cans 8. (See FIGS. 2 and 3).

For the sake of easily understanding the operation of the main carrier 13 and the auxiliary carrier 15, a mechanism for controlling the motion of the auxiliary carrier 15 in the first main passage $R_1$ is explained hereinafter. Referring to FIGS. 1, 2, 12, 13 and 14, at a side wall of the passage $R_1$, which is opposite the side wall provided with the plurality of stoppers $a_1, a_2, a_3, a_4$ . . . a plurality of stoppers $b_1, b_2, b_3, b_4$ . . . , are mounted at positions facing the stoppers $a_1, a_2, a_3, a_4$ . . . respectively, a plurality of detectors $d_1, d_2, d_3$ . . . are disposed at the side edge of the passage $R_1$ at corresponding positions above the stoppers $b_1, b_2, b_3, b_4$ . . . The structure and function of these stoppers and detectors are similar to the stoppers $a_1, a_2, a_3$ . . . and the detectors $c_1, c_2, c_3$ . . . except that the detector $d_1$ works with a magnetic relay $Rd_1$, which connects a magnetic relay 66 with the stopper $b_1$, the detector $d_2$ works with a magnetic relay $Rd_2$ which connects the magnetic relay 66 with the stopper $b_2$, the detector $d_3$ works with a magnetic relay $Rd_3$ which connects the magnetic relay 66 with the stopper $b_3$ and so forth. The magnetic relay 66 connects the electric source with these relays $Rd_1$, $Rd_2$, $Rd_3$ and so forth and the relay 66 is actuated by the control computer 31. When a full package can or empty can 8 is positioned on the detector $d_1$ ($d_2$, $d_3$ . . . ), the detector $d_1$ ($d_2$, $d_3$ . . . ) issues a signal to the corresponding magnetic relay $Rd_1$ ($Rd_2$, $Rd_3$ . . . ) so that the magnetic relay $Rd_1$ ($Rd_2$, $Rd_3$ . . . ) closes the circuit.

The cans-carrying motion by the auxiliary carrier 15 along the passage $R_1$ is hereinafter explained. When the control computer 31 issues signal to close the magnetic relay 30b, if the magnetic relay 30c has been closed so as to rotate the motor 26 in the reverse direction by another signal issued from the control computer 31, the carrier 15 is displaced from the rails 82 of the base frame 73*c* of the main carrier 13 into the passage $R_1$ in such a condition that the wheels 12 of the carrier 15 roll along the rails 29 (See FIG. 5) of the passage $R_1$. A mechanism for positioning the main carrier 13 at a particular position where the rails 82 are positioned along an extended line of the respective rails 29 will be explained later. When the auxiliary carrier 15 comes into the passage $R_1$, the stopper $b_1$ actuates the limit switch 32 so that the magnetic relay 30*b* is opened and, consequently, the carrier 15 is stopped at the position $P_{14}$. In this condition, the limit switch 32 issues a signal to the computer 31 so that the control computer 31 issues a signal to close the magnetic relay 30*a*and, accordingly, the motor 21 is driven. Consequently, the lifting member 11 of the carrier 15 lifts the full packaged can 8, and when the limit switch 33*a* is pushed by the projection 25*a* of the cam plate 25, the motion of the lifting member 11 is stopped. The limit switch 33*a* also issues a signal to the control computer 31 and the control computer 31 issues a signal to actuate the magnetic relay 30*c* so as to change the polarity of the supplied power, and also issues a signal to close the magnetic relay 30*b*. Therefore, the motor 26 is driven in the normal running direction so that the carrier 15 is displaced to the main carrier 13. When the carrier 15 is carried to a predetermined position on the base frame 72*c* of the main carrier 13, a non-contact limit switch 81, which is disposed on the base frame 72*c* of the main carrier 13, is actuated and the limit switch 81 issues a signal to open the magnetic relay 30*b* so that the carrier 15 is stopped on the base frame 72*c* of the main carrier 13. If the position $P_1$ does not have a can 8 and other positions corresponding to the detectors $d_2$, $d_3$, $d_4$ . . . are provided with full packaged cans 8 positioned thereon, the stopper $b_1$ does not work, but other stoppers $b_2$, $b_3$ . . . are actuated and, therefore, in the carrying operation successive to the above mentioned carrying operation, the auxiliary carrier 15 is stopped at the position corresponding to the stopper $b_2$ and the above-mentioned operation of the lifting members 11, and the carrying operation of the full packaged cans 8 from the position of the stopper $b_2$ to the predetermined positions above the non-contacting switch 81 of the main carrier 13 is carried out. With regard to the positions corresponding to the stoppers $b_3$, $b_4$ and so forth, a carrying motion by the auxiliary carrier 15 similar to the above-mentioned carrying motion with respect to the position corresponding to the stopper $b_2$ is carried out.

Figure 16:
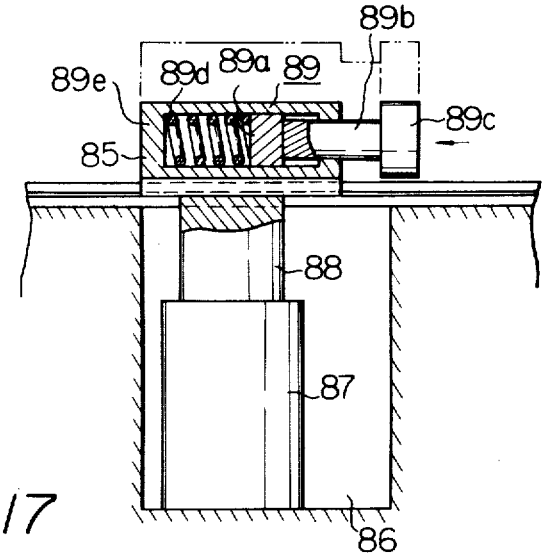
FIGS. 16 and 17 are schematic side and front views, respectively, of a damping stopper for stopping the combined transportation carrier shown in FIGS. 14 and 15.
Figure 17:
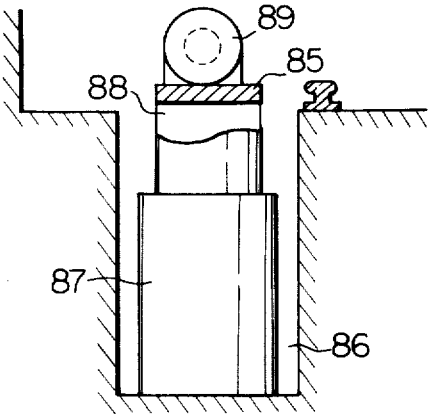
Figure 18:
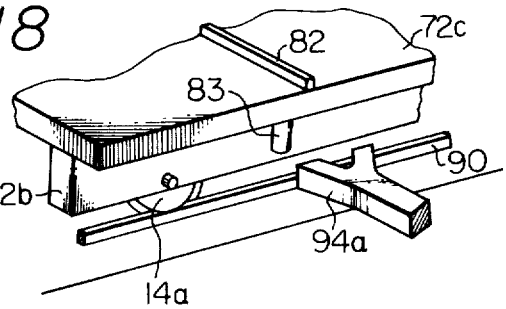
FIG. 18 is a schematic perspective view of a part of the combined transportation carrier shown in FIGS. 14 and 15, together with a part of a positioning member thereof.
Figure 19A:
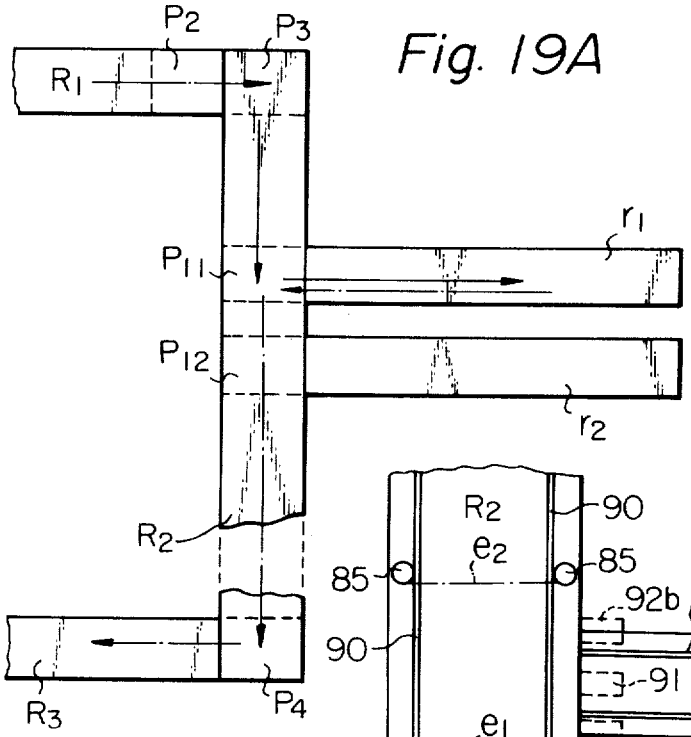
FIG. 19A is a schematic plan view of a transversal passage and part of the main passage and a pair of branched passage of the cans transportation passage shown in FIG. 1.
Figure 19B:
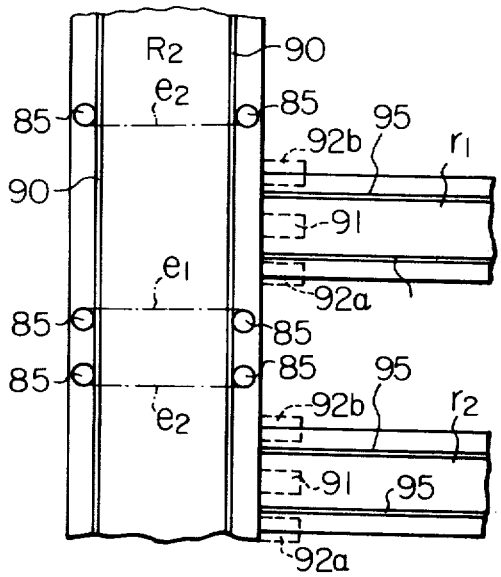
FIG. 19B is a schematic plan view of a connected portion of the branched passages where they are connected to the transversal passage, shown in FIG. 19A, wherein the arrangements of the stoppers, damping stoppers and positioning members are shown.
Figure 20:
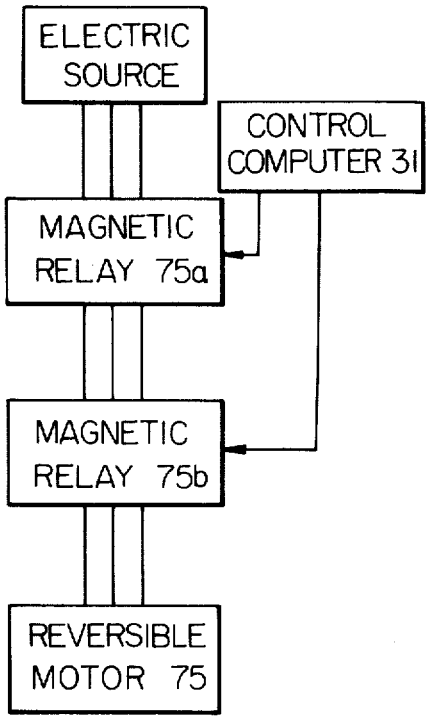
FIG. 20 is a block diagram of a control circuit of a main driving motor of the combined transportation carrier shown in FIGS. 14 and 15.
Figure 21:
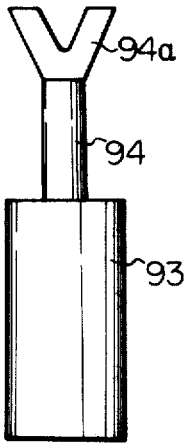
FIG. 21 is a side view of the positioning member shown in FIG. 18.
Figure 22:
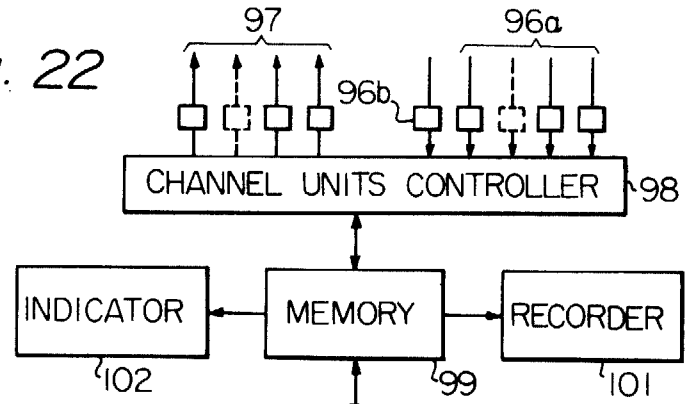
FIG. 22 is a block diagram of a control computer utilized to control the carrying operation of the cans along the transportation passage shown in FIG. 1.

Means for positioning the main carrier 13 at a desired position along the first transversal passage $R_2$ is hereinafter illustrated. Referring to FIGS. 14, 15, 16, 17, 18, 19A and 19B, a pair of damping stoppers 85 are disposed in recesses 86 formed in the base floor of the passage $R_2$ at a position adjacent to the desired position as shown in FIGS. 16 and 17. Eaach stopper 85 comprises a solenoid 87, provided with a plunger 88, and a damper 89 rigidly mounted at a top end of the plunger 88 as shown in FIGS. 16 and 17. The damper 89 comprises a piston 89*a* slidably disposed in a piston cylinder 89*e*, a piston rod 89*b* connected to the piston 89*a* and a head 89*c* formed at a free end of the piston rod 89*b*. An expansion spring 89*d* is disposed in a space in the cylinder 89*e* so as to resiliently position the piston 89*a* in the cylinder 89*e*. The damper 89 is capable of positioning at a location where the head 89*c* contacts a forward or rearward side surface 72*e* of the base frame 72*c* of the main carrier 13, when the solenoid 87 is actuated. The solenoids 87 are positioned at a position adjacently outside a pair of guide rails 90. Further, it is important to note that the contact positions of the head 89*c* of each damper 89 with the forward or rearward side surfaces 72*e*, which are represented by $e_1$, $e_2$ in FIG. 19B, are positioned in such a condition that the main carrier 13 is stopped at a correct position when the head 89*c* of the damper 89 contacts the forward or backward side surfaces of the base frame 72*c* of the main carrier 13. The above-mentioned correct position means that the guide rails 82 of the main carrier 13 coincide with the extended lines of the guide rails 95 mounted on a base floor of the branched passages $r_1$ and $r_2$. To stop the running of the motor 75 of the main carrier 13, a stopper 91, is disposed in a corresponding horizontal recess formed in a side wall of the passage $R_2$ at a central position with respect to the creel passage $r_1$ ($r_2$) as shown in FIG. 19B. A pair of positioning members 92*a* and 92*b* are disposed in corresponding horizontal recesses formed in a side wall of the passage $R_1$ at symmetrical positions on both sides of the stopper 91 as shown in FIG. 19B. The construction and function of the stopper 91 is quite similar to the stopper 50 of the passage $R_1$. That is, the stopper 91 actuates the limit switch 80 so as to stop the reversible motor 75. The reversible motor 75 is connected to an electric source via a magnetic relay 75*a* for opening and closing the above-mentioned connection and a magnetic relay 75*b* for changing the polarity of the input power from the electric source to the reversible motor 75 as shown in FIG. 20. The positioning member 92*a* (92*b*) comprises a solenoid 93 and a plunger 94 provided with a forked shaped head portion 94*a*, as shown in FIG. 21, and when the solenoid 93 is actuated so as to push the plunger 94 forward, the forked head portion 94*a* is capable of engaging with either one of the two upright rods 83 so that the stopped position of the main carrier 13 can be corrected. At the terminal positions $P_3$ and $P_4$ (FIG. 19A), there are provided a stopper, positioning member and damping stopper which are similar to those disposed at the positions for the branched passages Ra, Rb.

In each creel passage $r_1$, $r_2$, $r_3$ and $r_4$, there are provided two series of first stoppers which are similar to the series of stoppers $a_1$, $a_2$, $a_3$ . . . and second stoppers which are similar to the series of stoppers $b_1$, $b_2$, $b_3$ . . . disposed along the first main passage $R_1$. Further, there are provided with two series of first detectors which are similar to the series of detectors $c_1$, $c_2$, $c_3$ . . . and second detectors which are similar to the series of detectors $d_1$, $d_2$, $d_3$ . . .

In the preparing station $P_x$ of the second main passage $R_3$, there are provided two series of stoppers which are identical a first series of stoppers similar to the above-mentioned series of first stoppers and identical with a second series of stoppers similar to the above-mentioned series of second stoppers. These first stoppers and second stoppers are coupled with the series of first detectors and the series of second detectors, respectively. The functions of these stoppers and detectors are quite similar to those of the first main passage $R_1$.

Next the transporting operation of the full packaged cans 8 from the reserving position $P_r$ of the first main passage $R_1$ to the creeling position $P_s$ of the branched passage Ra, and the transporting operation of the empty cans 8 from the creeling position $P_s$ to the preparing position $P_x$ of the second main passage $R_3$ are illustrated in detail. With reference to FIGS. 1, 12, 14, 15, 16, 17, 18, 19A, 19B, 20, 21 and 22, a first counter (not shown) is mounted on a delivery mechanism of the spinning equipment S, and the first counter issues a pulse signal to the control computer 31 every time a predetermined length of the bundle of multifilament Y is delivered which corresponds to the completion of making a full packaged can 8. A conventional pulse counter actuated by a rotation member such as a nip roller of the spinning equipment S may be used for the present invention. A second counter having a structure and function similar to the above-mentioned first counter (not shown), which is actuated by a feed roller of the drawing equipment, is mounted on the drawing equipment, and the second counter provides an output pulse signal every time a predetermined length of the material, for example, 100 meters, is supplied into the drawing equipment, and the signal of the second counter is provided as an input into the control computer 31. In the present embodiment, the control computer 31 is provided with a plurality of input channel units 96*a* which receive pulse signals from the second counters; an input channel unit 96*b* which receives a pulse signal from the first counter; a plurality of output channel units 97, which transmit a control signal to either one of the stoppers 91 and the corresponding damping stoppers 85 and corresponding positioning member 92*a*, a channel units controller 98; a memory 99 which memorizes any data from the channel units controller 98 and the necessary program for processing the same; an arithmetic control unit 100 which carries out a programed calculation with regard to the memorized data of the memory 99, a recorder 101 which records the results of the computer 31, and; an indicator 102 which indicates the results of the computation by the computer 31. The result obtained by the arithmetic control unit 100 is fed back to the channel units controller 98, through the memory 99, and the output signal of the controller 98 is transmitted to the stopper, damper stopper and positioning member, as mentioned above. The input pulse signals from the channel units 96*a* are summed up each time the input of the pulse signal from the first counter through the input channel unit 96*b* is stored in the memory 99. The supply order of the pull packaged cans 8 to the creeling positions $P_s$ of the branched passages $R_a$ is sorted every time the input signal is received from the channel unit 96*b* by the action of the arithmetic control unit 100 in such a way that the creel position corresponding the second counter, in which the summed value of the number of the pulse is largest, is sorted from other creel positions. Other signals are issued from the creel passages $r_1$, $r_2$, $r_3$, $r_4$ if these branch passages are occupied with cans 8, and the above-mentioned signal is transmitted to the control computer 31 by way of other input channel units. In the above-mentioned programed calculation by the arithmetic control unit, the sorting operation of the output channel unit is carried out only for the output channel units where there is no signal from the respective creel passage $r_1$, $r_2$, $r_3$ and $r_4$. To issue a signal from the above-mentioned branched passages, detectors having a structure and function similar to the detectors $c_1$, $c_2$, $c_3$ . . . shown in FIG. 13 are utilized.

When the value of the summed input pulse from the first counter through the input channel unit 96*b* reaches a predetermined value in the memory 99, the arithmetic control unit 100 issues a control signal to close the magnetic relay 75*a* and also to actuate the magnetic relay 75*b*, so as to supply a power of reverse polarity, and the motor 75 is driven in reverse rotational direction. The arithmetic control unit 100 also issues a signal to actuate the stopper 91 and corresponding damping stoppers 85, which correspond to the branched passage sorted by the arithmetic control unit 100 of the control computer 31, by way of the output channel unit 97 corresponding to the branched papssage concerned. According passage the above-mentioned operation of the control computer 31, the main carrier 13 runs along the rails 90 toward the upstream terminal $P_3$. Therefore, when the main carrier 13 arrives at the position $P_3$, the limit switch 80 is actuated by the stopper (not shown) so that the running of the motor 75 is stopped. The carrier 13 tends to move a little forward because of the momentum thereof, however, the damping stopper (not shown) works to stop the carrier 13 at the position $P_3$. At this moment, the positioning member (not shown) is actuated by a signal issued from the limit switch 80 via the control computer 31, so that the forked head of the positioning member (not shown) engages the rod 83 and the carrier 13 is stopped at the correct position. In this condition, the control computer 31 receives a signal indicating the engagement of the rod 83 with the forked head of the positioning member by a conventional detector (not shown), such as a limit switch disposed on the base frame 72*c*, and then issues a signal to actuate the magnetic relay 30*b* (see FIG. 9). Therefore, the auxiliary carrier 15 is displaced to the passage $R_1$ and the carrying motion of the full packaged can 8 from the position $P_2$ to the position $P_3$ is carried out as already illustrated. When the limit switch 81 detects the arrival of the auxiliary carrier 15, the limit switch 81 issues a signal to the control computer 31. Then the control computer 31 issues a signal to operate the above-mentioned stopper (not shown), damping stopper (not shown) and the positioning member (not shown), so as to return then to their waiting condition, and also issues a signal to close the magnetic relay 75*a* and actuate the magnetic relay 75*b* so as to supply power of normal polarity to the motor 75. Therefore, the main carrier 13 is displaced to the terminal of the branched passages Ra.

Simultaneous with the above-mentioned actuation of the magnetic relays 75*a*, 75*b*, the control computer 31 also issues a signal to actuate the stopper 91 and damping stopper 85 of the passage $r_1$ (or $r_2$, $r_3$, $r_4$) where all detectors issue signals indicating that there are no cans 8 thereon. When the main carrier 13 arrives at the terminal position corresponding to the above-mentioned passage, for example the passage $r_1$, the stopper 91 actuates the limit switch 80, so that the limit switch 80 opens the magnetic relay 75*a* and, therefore the motor 75 is stopped. The damping stopper 85 works with the base frame 72*c* so that the carrier 13 is stopped at the required position $P_{11}$ (or $P_{12}$). In this condition, the limit switch 80 also issues a signal to the control computer 31 and, then, the control computer 31 actuates the positioning member 92*a*, that is the solenoid 93, so that the plunger 94 projects and the forked head 94*a* engages the rod 83. This engagement is detected by a detector such as the limit switch (not shown) which issues a signal to the control computer 31 and, accordingly, the control computer 31 issues a signal to actuate the motor 26, as already explained. Consequently, the auxiliary carrier 15 is displaced into the branched passage $r_1$ and a full packaged can 8 is carried to the inside terminal of the passage $r_1$. Thereafter, the auxiliary carrier 15 is returned to the position on the base frame 72*c* of the main carrier 13 in a manner similar to the carrying operation of the can 8 from the reserving position $P_r$ in the first main passage $P_1$ to the main carrier 13. When the limit switch 81 detects the arrival of the auxiliary carrier 15 at the predetermined position on the base frame 72*c* of the main carrier 13, the limit switch 81 issues a signal to stop the running of the motor 26 and also issues a signal to the control computer 31. Accordingly, the control computer 31 issues a signal to drive the motor 75 in the reverse direction as already explained. Therefore the main carrier 13 is displaced to the terminal $P_3$ of the passage $R_2$. As mentioned above, the can carrying and supplying operations which move the full packaged cans 8 from the reserved position $P_r$ of the first main passage $R_1$ to the creeled position $P_s$ of the creel passage $r_1$, $r_2$, $r_3$, $r_4$ are carried out one at a time. When the last of the full packaged cans 8 is positioned on the corresponding detector, this detector issues a signal to the control computer 31 so as to open the magnetic relay 75*a*, so that the motion of the main carrier 13 is stopped.

In the above-mentioned operation, the stopper 91 and the positioning member 92*a* are returned to their original positions by the control computer 31 when the limit switch 81 detects the arrival of the auxiliary carrier 15 at the predetermined position on the base frame 72*c* of the main carrier 13. However, the damping stopper 85 is returned to it original position by a signal simultaneously issued from the control computer 31 when the control computer 31 issues the signal to open the magnetic relay 75*a* at the time of completion of the carrying operation of the full packaged cans 8 to the creel passage $r_1$, $r_2$, $r_3$, $r_4$ as illustrated already.

When predetermined length of plural bundles of multifilaments Y have been supplied from the cans 8 positioned at the branched passage Ra to the drawing equipment, by way of creels $C_1$ (or $C_2$), a counting device such as a conventional counting meter issues a signal to the control computer 31. Then the control computer 31 issues a signal to indicate that the cans 8 have become empty. In this situation, fresh bundles of multifilaments Y, which have completed a preparation of creeling them, are manually led to the feed mechaism of the drawing equipment. When the changing operation of the supply source of the bundles of multifilaments Y at the creel $C_1$ (or $C_2$) has been completed, the operator pushes an actuation button to provide an input signal so as to discharge the empty cans 8 from the creel passages $r_2$ (or $r_3$, $r_4$). The control computer 31 issues a signal to displace the main carrier 13 to the connecting position $P_{11}$ (or $P_{12}$) of the transversal passage $R_2$ with the creel passage $r_2$ (or $r_3$, $r_4$) in a manner similar to the above-mentioned case of supplying the full packaged cans 8 to the branched passage $r_1$. In this operation, the stopper 91, the damping stopper 85 and the positioning member 92b are operated in a manner similar to the above-mentioned case of supplying the full packaged cans 8 to the creel passage $r_2$. The discharging of the empty cans 8 from the creel passage $r_2$ is carried out in a manner quite similar to the case of carrying the full packaged cans from the reserved position $P_r$ of the first main passage $R_1$ to the main carrier 13 positioned at the terminal $P_3$ of the passage $R_2$. The empty cans 8 are transported to the preparing position $P_x$ of the second main passage $R_3$ from the branched passage $r_2$ one by one. The motion of the main carrier 13 between the above-mentioned connecting position $P_{11}$ (or $P_{12}$) and the downstream terminal $P_4$ of the first transversal passage $R_2$ is carried out in a manner similar to the motion of the main carrier 13 between the terminal $P_3$ and the position $P_{11}$ (or $P_{12}$) which has already been explained. Further, the carrying motion of the empty cans 8 from the terminal $P_4$ to the preparing position $P_x$ of the second main passage $P_3$ by the auxiliary carrier 46 is carried out in a manner quite similar to the carrying motion of the full packaged cans 8 by the carrier 13 from the position $P_{11}$ (or $P_{12}$) to the branched passage $r_1$.

A Carrier and Related Mechanism in the Second Main Passage $R_3$.

As already explained, in the second main passage $R_3$, the empty cans 8 carried from the branched passage $R_a$ via the first transversal passage $R_2$ are inspected at the preparing station $R_x$ to determine whether any of the undrawn bundle of multifilaments Y is still remained in the can 8. If there is filament material remaining in the can 8, such material is taken out of the can 8 manually or by a mechanical means such as a pneumatic means utilizing suction air. The second main passage $R_3$ is provided with a carrier (not shown) having a structure and function which are quite similar to the carrier 10*a* (10*b*) of the first main passage $R_1$. The empty cans 8 which have completed the above-mentioned inspection, are then carried to a waiting position $P_w$ adjacent to the downstream terminal $P_6$ of the passage $R_3$ by the carrier (not shown) from the position $R_x$ one by one. A plurality of stoppers and detectors having a quite similar structure and function to those of the stoppers $a_1$, $a_2$, $a_3$ . . . and $b_1$, $b_2$, $b_3$ . . . , the detectors $c_1$, $c_2$, $c_3$, and $d_1$, $d_2$, $d_3$ . . . are disposed to the waiting position. Therefore, the carrying operation of the empty cans 8 from the position Px to the position Pw is carried out in a manner similar to the carrying operation of the full packaged cans 8 from the position $P_1$ to the reserve position Pr of the first main passage $R_1$. When the above-mentioned carrying operation is completed, the carrier is stopped at the position $P_{13}$ between the positions Pw and Px. In this first embodiment, it is essential to provide a relatively large space for receiving the empty cans 8 at the preparing position $P_x$, because of the intermittent displacement of a predetermined number of empty cans 8 from the position $P_x$ to the waiting position $P_w$. However, if it is impossible to provide such a large space for preparing position $P_x$ along the passage $R_3$, the auxiliary carrier 15 of the main carrier 13, utilized for the second transversal passage $R_4$, can be used for carrying out a particular method for displacing cans 8 toward the terminal $P_6$ one by one during the time before the empty can 8 are carreid from the terminal $P_6$ to the terminal $P_9$. That is, the auxiliary carrier 15 moves toward the preparing position $P_x$ in a condition that its lifting member (11) is positioned at its lowermost position, and when the carrier 15 arrives at a position where the empty can 8, which is ready to be displaced, is positioned, the lifting member is elevated toward its uppermost position, and then the carrier 15 is displaced toward the terminal $P_6$. When the carrier 15 is stopped at a position of the waiting position $P_w$, which is a downstream position to a position where an empty can 8 has been positioned previously, the lifting member (11) is displaced toward its lowermost position so that the carrier empty can 8 is positioned on the floor A at the waiting position $P_u$. Next, the carrier 15 is displaced toward the preparing position $P_x$, and the above-mentioned empty cans displacing operation by the carrier 15 is continued, in order to fill the waiting position $P_u$ with the empty can 8. The above-mentioned particular transporting method of the empty cans 8 is hereinafter referred to as a tact transportation method for the cans.

A Main Carrier and an Auxiliary Carrier in the Second Transversal Passage $P_4$ In the second transversal passage $R_4$, a main carrier and an auxiliary carrier having constructions and functions quite similar to the main carrier 13 and the auxiliary carrier 15 are utilized. As previously illustrated, the second transversal passage $R_4$ is utilized only for carrying an empty can 8 from the waiting position $P_u$ on the second main passage $R_3$ to an upstream terminal $P_9$ of the first main passage $R_1$. At the both terminals $P_7$ and $P_8$ of the passage $R_4$, there are provided a stopper, a damping stopper and a positioning member, respectively. They are quite similar to those elements disposed at both terminals $P_3$ and $P_4$ of the first transversal passage $R_2$. When the detector (not shown) disposed at the position $P_9$ detects that an empty can 8 has been carried to the position $P_{10}$ by the carrier $10_a$, the detector issues a signal to the control computer 31. Therefore, the control computer 31 issues a signal to actuate the motor 75 of the main carrier so as to displace the main carrier to the upstream terminal $P_7$ of the passage $R_4$. When the main carrier arrives at the position $P_7$, the stopping position of the main carrier is corrected by the positioning member (not shown). Thereafter, the auxiliary carrier takes an empty can 8 from the position $P_6$ and returns to a predetermined position on the main carrier 13. Then the main carrier is displaced to the downstream terminal $P_8$ and stopped at the correct position, and the auxiliary carrier carries an empty can 8 to the position $P_9$ and returns to its waiting position on the main carrier 13. In the above-mentioned operation, the stopper, damping stopper, magnetic relays, etc. are operated by the control computer 31 in a manner similar to the operations already illustrated. Therefore, a detailed explanation of these operation is omitted.

In the above-mentioned first embodiment of the present invention, additional passage Ar1, Ar2 for reserving full packaged can 8 may be utilized. In these passages Ar1 and Ar2, stoppers, detectors and carriers which are similar to the above-mentioned stoppers, detectors and carriers are utilized.

Creel Mechanism and Cans Arrangement

Figure 4A:
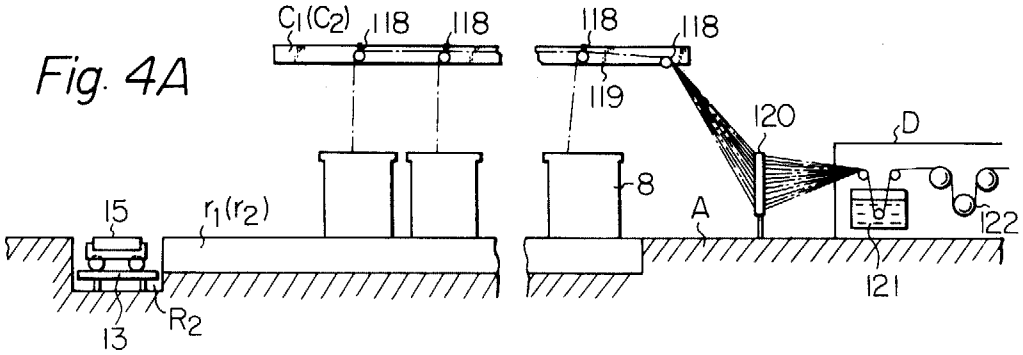
FIGS. 4A and 4B are a schematic side view and a plan view respectively, of a branched passage and the creel portion of a drawing device, shown in FIG. 1.
Figure 4B:
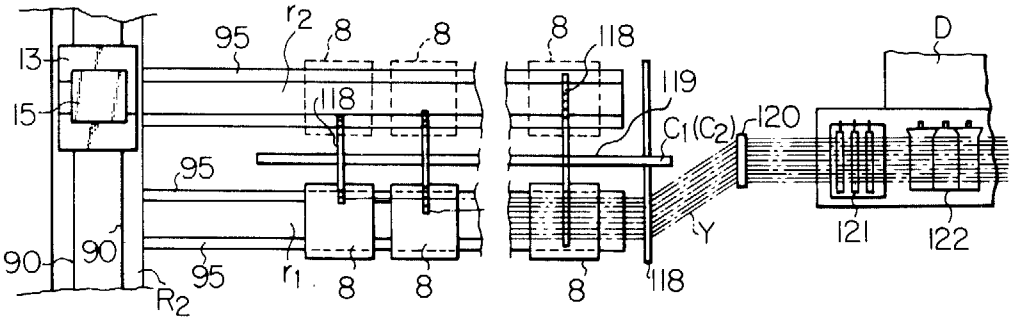

Referring to FIGS. 4A and 4B, in the first embodiment of the present invention, a pair of branched passages $r_1$ and $r_2$ (or $r_3$ and $r_4$) are formed along the creel $C_1$ ($C_2$) on the floor A at a position below the creel $C_1$ ($C_2$). Each creel $C_1$ ($C_2$) is provided with a plurality of horizontal guide rods 118 arranged in parallel condition to each other in such a way that each guide rod 118 is transversely mounted on a longitudinal bracket 119, which is extends along the supplying direction of the bundle of multifilaments to the drawing equipment D. Each guide rod 118 is provided with a plurality of guide members (not shown). A thread guide strand 120 is disposed at a position between the creel $C_1$ ($C_2$) and the drawing equipment D. A plurality of bundles of multifilaments Y are continuously taken from the respective cans 8 and then led to the corresponding guide members of the guide rods 118 and, thereafter, they are introduced into an oiling bath 121 of the drawing equipment D by way of the guide stand 120. Then the bundles of multifilaments Y are introduced into a set of feed rollers 122 of the drawing equipment D. During the above-mentioned feeding operation of the bundles of multifilaments Y into the drawing equipment D, a predetermined number of full packaged cans 8 are carried to the empty branched passages, for example, the branched passage $r_2$ as shown by dotted lines in FIG. 4B, and the bundles of multifilaments Y are creeled on the creel $C_1$ through free guide members of the respective guide rods 118. When it is required to change the supply source of the material bundles of multifilaments Y from the cans 8 positioned on the creel passage $r_1$ to the full packaged cans 8 positioned on the creel passage $r_2$, the bundles of multifilaments Y, which have been fed from the cans 8 on the passage $r_1$, are cut at a position between the creel $C_1$ ($C_2$) and the guide stand 120, and the fresh bundles of the multifilaments Y from the full packaged cans 8 positioned on the passage $r_2$ are threaded in the guide stand 120. Then the free forward end portion of the above-mentioned fresh bundles of multifilaments Y is bound with a free rearward end portion of the previous bundles of multifilaments Y. The above-mentioned operation is carried out manually. According to the above-mentioned fresh creeling operation, the damage to the working efficiency of the drawing equipment D by the creeling operation can be remarkably reduced.

Figure 23:
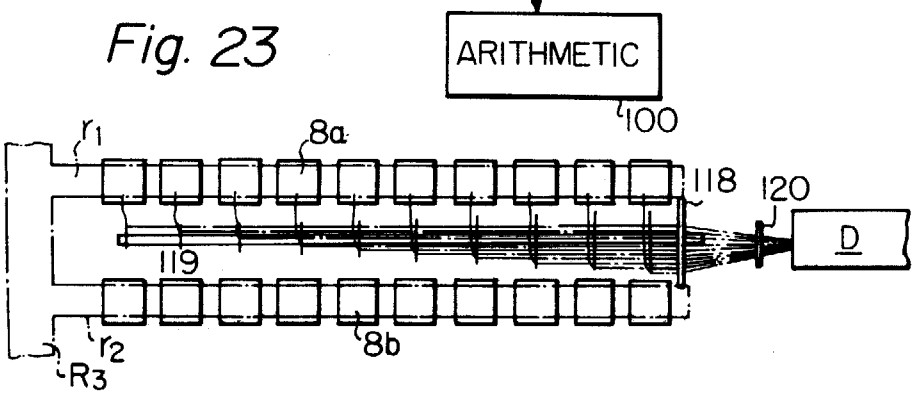
FIG. 23 is a schematic plan view of the arrangement of cans at the supplying positions along the branched passages of the cans transportation passage shown in FIG. 1.
Figure 24:
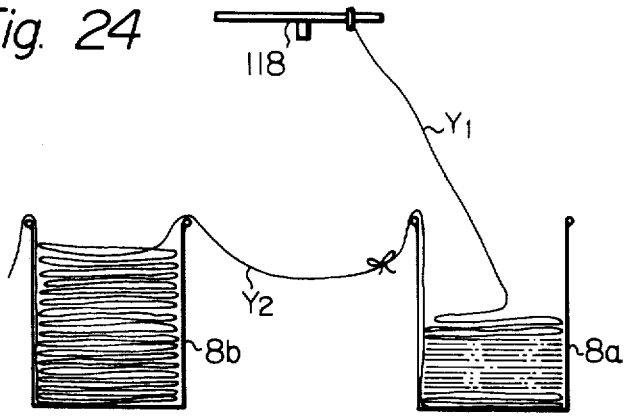
FIG. 24 is a schematic cross-sectional view of a previously supplied can and a freshly supplied full packaged can, wherein a method of connecting a tail-end and portion of the material contained in the first mentioned can with a starting end of the material contained in the second mentioned can is shown.

A modified embodiment of the creeling operation is shown in FIG. 23, wherein a pair of creel passages $r_1$ and $r_2$ (or $r_3$, $r_4$) appears as in the as the first embodiment. In this embodiment, during the feeding operation from the cans 8a positioned on the branched passage $r_1$ (or $r_2$), a rear end portion of the bundle of multifilaments Y from each can 8*a* positioned on the passage $r_1$ is bound with a forward end portion of a bundle of multifilaments Y of a can 8*b* positioned on the branched passage $r_2$ at a position facing the can 8*a* as shown FIG. 24. Consequently, the creeling operation of the fresh cans 8 can be remarkably simplified.

Several Modifications of the Present Invention

Figure 26:
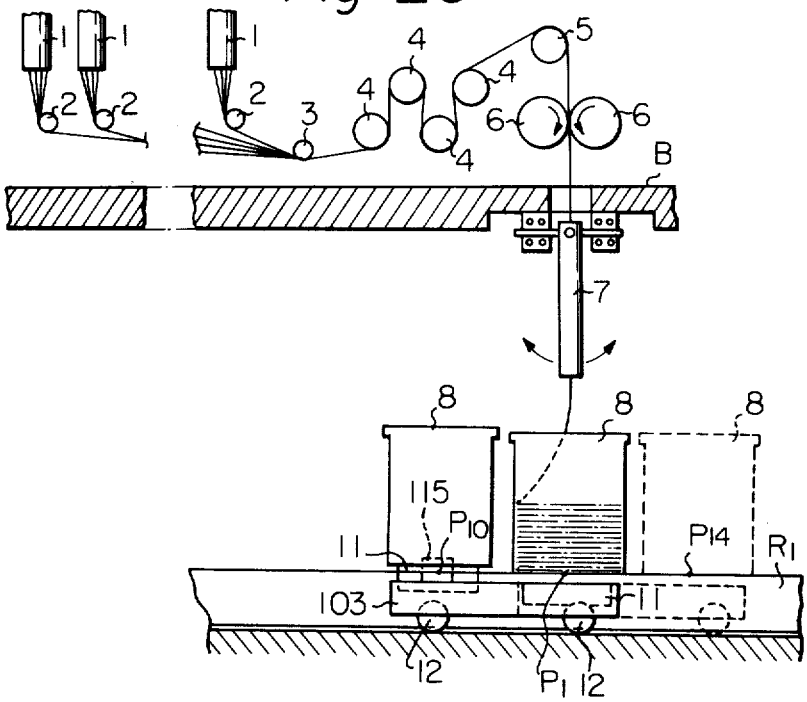
FIG. 26 is a schematic cross sectional view of a main passage of the transportation passage wherein the modified carrier shown in FIG. 25 is utilized.
Figure 25:
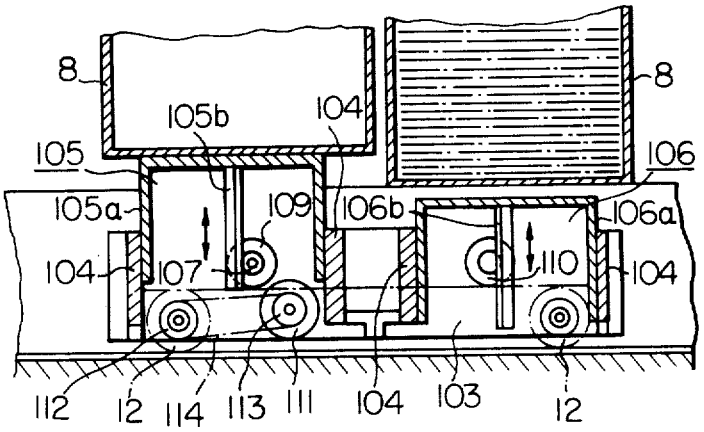
FIG. 25 is a schematic cross sectional side view of a modified carrier according to the present invention.

In the above-mentioned first embodiment of the present invention, a pair of carriers 10*a* and 10*b* are utilized to carry the empty cans 8 and the full packaged cans 8 along the first main passage $R_1$. The carrier 103 shown in FIGS. 25 and 26 is utilized on the main passage $R_1$, instead of the carriers 10*a* and 10*b*. In this embodiment the carrier 103 is capable of moving toward the downstream terminal $P_2$ or the upstream terminal $P_9$ of the main passage $R_1$.

The carrier 103 comprises a pair of lifting members 105 and 106 which are capable of moving upward and downward. The carrier 103 is provided with a guide member 104 to guide the lifting motion of the lifting members 105 and 106. The lifting member 105 comprises a upright side wall 105*a* and an upright bar 105b provided with a rack. A reversible motor 109 is mounted on the carrier 103 and a pinion 107 secured on a shaft of the motor 109 meshes with the rack of the bar 105*b* so that the bar 105*b*, that is, the lifting member 105 is capable of moving upward or downward. The above-mentioned upward and downward motions of the lifting members 105 and 106 are stopped by a pair of limit switches (not shown) which open the connection between the electric source and the respective motors 109, 110. During the above-mentioned motion of the lifting member 103, the side wall 105*a* slides along the guide member 104. The lifting member 106 comprises elements identical to the elements of the lifting member 105 and, consequently, the reference numerals of these elements are only discribed. That is, 106*a*. 104*b* represent a side wall and an upright bar, and 108 and 110 represent a reversible motor and a pinion. The carrier 103 is also provided with two pairs of wheels 12 secured on corresponding horizontal shaft turnably mounted on the carrier 103. A reversible motor 111 is mounted on the carrier 103 and one of the shafts of the above-mentioned wheels 12 is driven by the motor 111 by way of a power transmission mechanism comprising a pulley 113 secured on a shaft of the motor 111 and a pulley 112 secured on a shaft of the wheels 12 and an endless belt 114 which transmits the driving power from the pulley 113 to the pulley 112. The turning direction of the reversible motors 109, 110 and 111 is changed by respective reversible magnetic relays having a structure and function identical to the reversible magnetic relay shown in FIG. 9. The carrier 103 is provided with a limit switch 115, having a structure and function identical to the limit switch 32 of the carrier 10*a*. The limit switch 115 is actuated by stoppers (not shown) disposed to the side wall of the passage $R_1$ at the positions $P_{10}$ and $P_1$. The above-mentioned stoppers are identical to the stopper 51.

In the case of utilizing the above-mentioned carrier 103, the carrier 103 is stopped at the positions $P_9$, $P_{10}$, $P_2$ and any positions where stoppers, which are identical to the stopper 50, are disposed, in a manner similar to the first embodiment. Next, the motion of the carrier 103 at the position $P_{10}$ and $P_1$ is hereinafter explained. During the supplying operation of a bundle of multifilaments Y into a can 8 positioned at $P_1$, the carrier 103, wherein the lifting member 106 is positioned at its lowermost waiting position and the lifting member 105 is positioned at its uppermost position so as to support an empty can 8, is displaced from the position $P_9$ to the position $P_{10}$. The carrier 103 is stopped at the position $P_{10}$ by the stopper (not shown) which actuates the limit switch 115. Next, the control computer 31 issues a signal to change the polarity of the supply power to the motor 109. Consequently, the lifting member 105 is displaced to its lowermost position where the empty can 8 is positioned on the floor A. When a predetermined length of bundle of multifilaments Y has been supplied into the can 8 positioned at $P_1$, a counter issues a signal to the control computer 31, the control computer 31 issues a signal to actuate the motors 109 and 110 so as to displace the lifting members 105 and 106 upward and, then, issues a signal to simultaneously actuate the stopper (not shown) disposed at the position $P_1$ and the motor 111 so that it will rotate in its normal running direction. Consequently, the empty can 8 and the full packaged can 8 are first raised by the lifting members 105 and 106 to a position free from the floor A and, then, the carrier 103 is moved toward the downstream terminal $P_2$. When the above-mentioned stopper actuates the limit switch 115, the carrier 103 is stopped at the position $P_1$. The limit switch 115 also issues a signal to the control computer 31 so as to actuate the motors 109 and 110 by changing the polarity of the input power of the motors 109 and 110. Therefore, the lifting members 105, 106 are displaced to their lowermost positions so that the full packaged can 8 is positioned at a position $P_{14}$, while the empty can 8 is positioned at the position $P_1$. Consequently, a supply of the bundle of multifilaments Y is discharged into the fresh empty can 8 positioned at the position $P_1$. Thereafter, the bundle of multifilaments Y is cut manually between the empty can 8 and the full packaged can 8. The carrier 103 is utilized to carry the full packaged can 8 from the above-mentioned position $P_{10}$ to the reserving position Pr of the main passage $R_1$, and to carry the empty can 8 from the position $P_9$ to the position $P_{10}$ in a similar manner to the carriers 10a, 10b.

Figure 27:
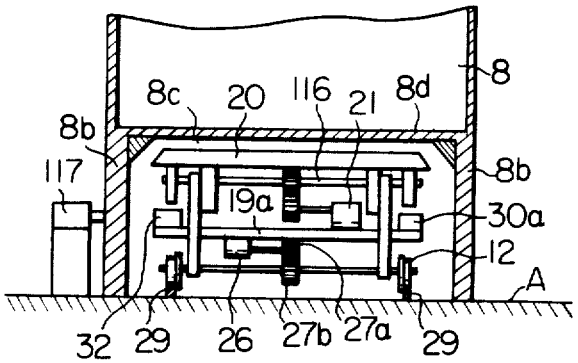
FIG. 27 is a schematic front view of another modified carrier and a cross sectional view of a modified can, according to the present invention.
Figure 28:
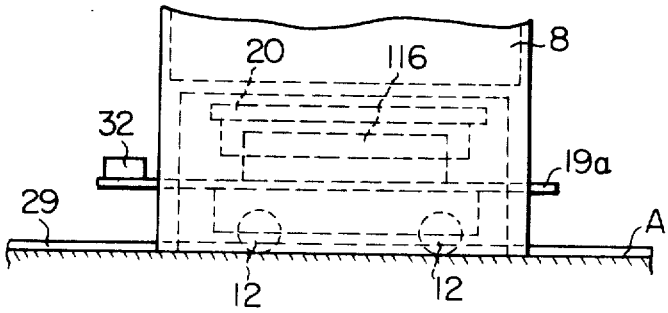
FIG. 28 is a schematic side view of the modified carrier and can shown in FIG. 27.
Figure 29:
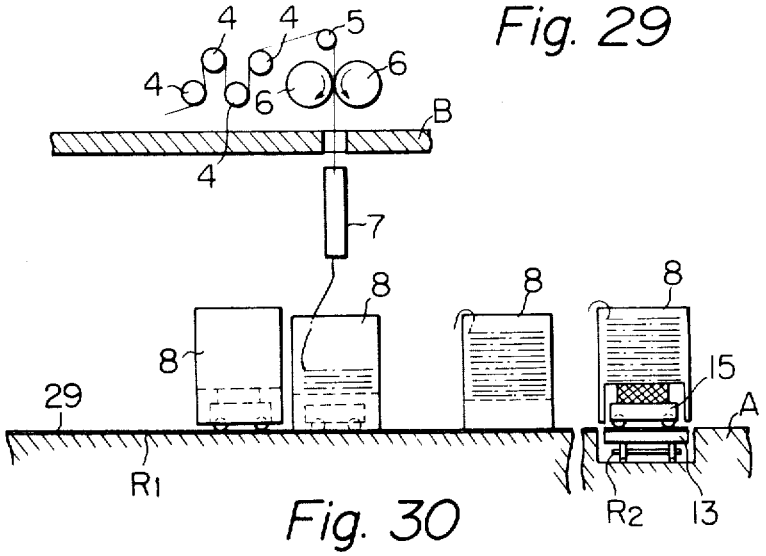
FIG. 29 is a schematic cross sectional view of a main passage of a modified transportation passage according to the present invention, wherein the modfied carrier and cans shown in FIG. 27 are shown together with a schematic side view of a delivery part of a spinning equipment.

Another embodiment of the carrier, which is utilized for the main passages $R_1$ and $R_2$, is shown in FIGS. 27, 28 and 29. In this embodiment, instead of utilizing a grooved passage as in the first embodiment, the passage $R_1$ is formed on the floor A by a pair of guide rails 29 as shown in FIG. 27. The cans 8 utilized for this embodiment are provided with a pair of legs 8*b* extending downward as shown in FIG. 27, in such a condition that a space 8*c* formed by a bottom plate 8*d* and the legs 8*b* is capable of containing the carriers 116 therein. When the lifting table of the carrier 116 is displaced to the uppermost position thereof, the lifting table 20 moves the can 8 upward so that the bottom ends of the legs 8*b* are separated from the floor A and, on the other hand when the lifting table 20 is displaced to its lowermost position, the bottom ends of the legs 8*b* are positioned on the floor A and the table 20 is separated from the bottom plate 8d of the can 8. In this latter condition, the carrier 116 is capable of moving along the rails 29 in a condition free from the cans 8. As the structure and function of the carrier 116 is quite similar to the carrier 10*a*, 10*b*, the detailed illustration of the structure and function thereof is omitted. The only difference between the carrier 116 and 10*a* (10*b*) is the base frame 19*a*, and the disposition and construction of the stopper 32. As the two sides of the carrier 116 are covered with the legs 8*b* of the can 8, the base frame 19*a* is provided with a longitudinal length which is sufficiently larger than the size of the can 8 to dispose the limit switch 32 outside the legs 8*b* as shown in FIG. 28. Instead of utilizing the stopper 50 of the first embodiment, stoppers 117 are disposed on the floor A at outside adjacent positions along the passage of the cans 8 as shown in FIG. 27. In this embodiment, the stopper 117 is a light emitter which is actuated by the control computer 31 in such a way that when the control computer 31 issues a signal to actuate the stopper 117, the stopper 117 emits a beam of light toward the tracing passage of the limit switch 32 of the carrier 116. The limit switch 32 is provided with a photocell (not shown) which issues a signal when the photocell receives the light emitted from the stopper 117. Consequently, the carrier 116 is capable of working in a manner similar to the carrier 10*a* and 10*b* (FIG. 5). The main carrier 13 for this embodiment is identical to the main carrier 13 of the first embodiment, while the auxiliary carrier 15 for this embodiment is identical to the above-mentioned carrier 116.

As the main passages $R_1$ and $R_2$ are not grooved passages, but only formed by a pair of guide rails 29, manual operation along the space of the main passages $R_1$ and $R_2$ is facilitated in comparison with the first embodiment.

Several modifications of the can transporting system according to the present invention are hereinafter described in detail. These modified systems are shown in FIGS. 30, 31, 32, 33, 34, 35 and 36 wherein elements identical to the elements shown in FIG. 1 are represented by the same reference numerals and explanations of these elements are omitted in the following description.

Figure 30:
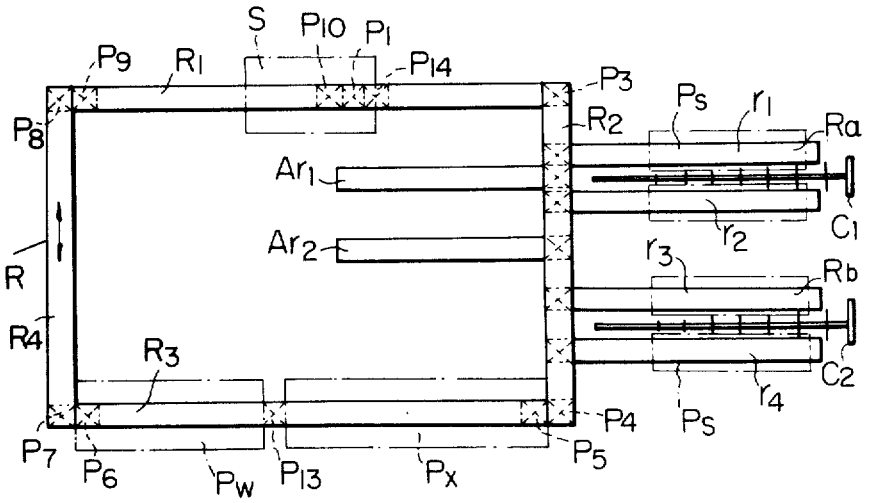

A first modification of the can transporting system is shown in FIG. 30. In this embodiment, the carrier 103 shown in FIGS. 25 and 26 is utilized instead of the carriers 10a, 10b of the first embodiment. In this embodiment, the method for supplying the full packaged cans 8 to the supplying position Ps of the branched passage Ra is quite different from the first embodiment. That is, instead of reserving a plurality of full packaged cans 8 at the reserving position Pr of the first main passage $R_1$ and then supplying them to the supplying position Ps of the branched passage Ra from the position Pr one by one as a group, a full packaged can 8 is transported directly from the position $P_{14}$ to a position on the supply position Ps of a particular creel passage $r_1$, $r_2$, $r_3$ or $r_4$ by the combined transportation equipment comprising the main carrier 13 and the auxiliary carrier 15, in response to a sorting signal of the control computer 31 every time a full packaged can 8 is produced.

Figure 31:
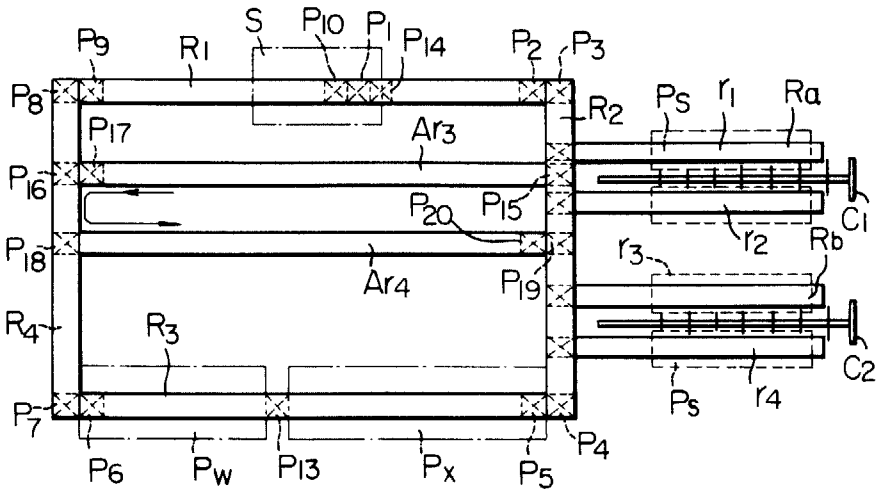

In a second modified system shown in FIG. 31, a pair of parallel passages $Ar_3$ and $Ar_4$, which are connected to the first and second transversal passages $R_2$ and $R_4$ at positions $P_{15}$ and $P_{16}$, $P_{18}$ and $P_{19}$, are utilized instead of the auxiliary passages $Ar_1$, $Ar_2$ in the first embodiment. The auxiliary passages $Ar_3$ and $Ar_4$ are utilized for reserving excess full packaged cans 8 in such a way that the excess full packaged cans 8 are supplied into the passage $Ar_3$ by an auxiliary carrier 15 of the combined transportation equipment utilized for the passage $R_2$ in a manner similar to transport of the full packaged cans into the branched passage Ra. When it is required to transport the full packaged cans 8 reserved on the auxiliary passage $Ar_3$ to one of the branched passages Ra and Rb, the full packaged cans 8 are first carried from the passage $Ar_3$ to the passage $Ar_4$ by an auxiliary carrier 15 of the combined transportation equipment utilized for the second transversal passage $R_4$ and, then, the full packaged cans 8 are supplied to the supplying position of one of the branched passages Ra and Rb by the auxiliary carrier 15 of the combined transportation equipment utilized for the first transversal passage $R_2$.

It is also preferable to reserve the full packaged cans 8 on the passage $Ar_4$ before supplying them to one of the branched passages Ra and Rb. In this case, it is preferable to use, the tact transportation method for cans 8, which is illustrated in the explanation of the first embodiment, for transporting the cans to the terminal $P_{20}$. In the drawing, $P_{15}$, $P_{16}$, $P_{18}$, $P_{19}$ are terminals where the passages $Ar_3$ and $Ar_4$ are connected to the first and second transversal passages $R_2$ and $R_4$.

Figure 32:
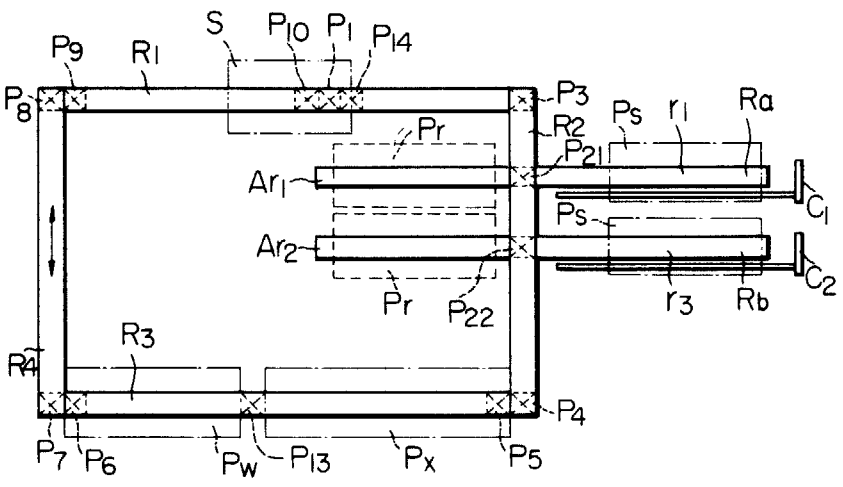

In the third modified system of the present invention, shown in FIG. 32, instead of utilizing a pair of branched passages at both sides along the creels $C_1$, $C_2$, single creel passages $r_1$, $r_3$ are arranged to the respective creels $C_1$, $C_2$. In this embodiment, the auxiliary passage $Ar_1$ branches from the first transversal passage $R_2$ at the position $P_{21}$ wherefrom the branched passage $r_1$ is branched, while the auxiliary passage $Ar_2$ branches from the first transversal passage $R_2$ at the position $P_{22}$ wherefrom the branched passage $r_2$ is branched. A carrier 103 shown in FIG. 25 is utilized for carrying the empty and full packaged cans 8 along the first main passage $R_1$ instead of the carriers 10*a*, 10*b*. The full packaged cans 8 are carried to the reserving positions Pr of the passage $Ar_1$ and $Ar_2$ by the auxiliary carrier 15 of the combined transporting equipment utilized in the second transversal passage $R_2$ and, when it is required to supply the full packaged cans 8 to one of the branched passage $r_1$, $r_2$ from the respective reserving passage $Ar_1$ and $Ar_2$, the above-mentioned auxiliary carrier 15 is utilized in a manner similar to that in the first embodiment.

Figure 33:
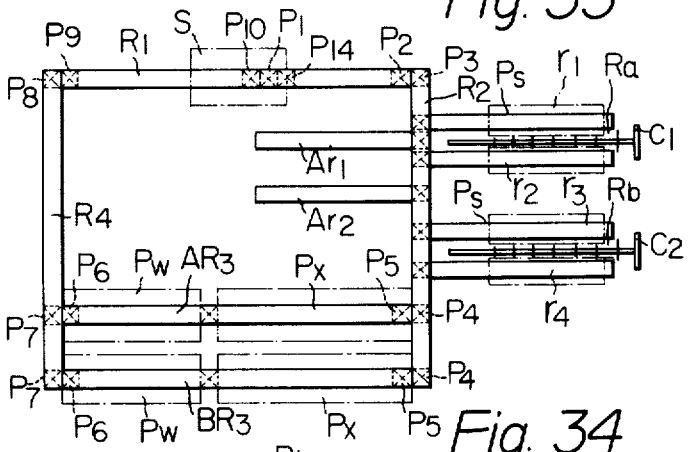

In the fourth modified system shown in FIG. 33, which is similar to the first embodiment, a pair of third passages $AR_3$ and $BR_3$ are applied instead of a single third passage $R_3$. These passages $AR_3$ and $BR_3$ have a structure and function identical to each other and also identical to the passage $R_3$ of the first embodiment. In this embodiment, since double passages $AR_3$ and $BR_3$ are utilized to prepare the empty cans 3 and reserve the empty cans 3 at the respective waiting positions Pw, the length of the main passages $R_1$, $R_3$ ($AR_3$, $BR_3$) can be reduced remqrkably in spite of maintaining a large capacity for reserving the empty cans 8.

Figure 34:
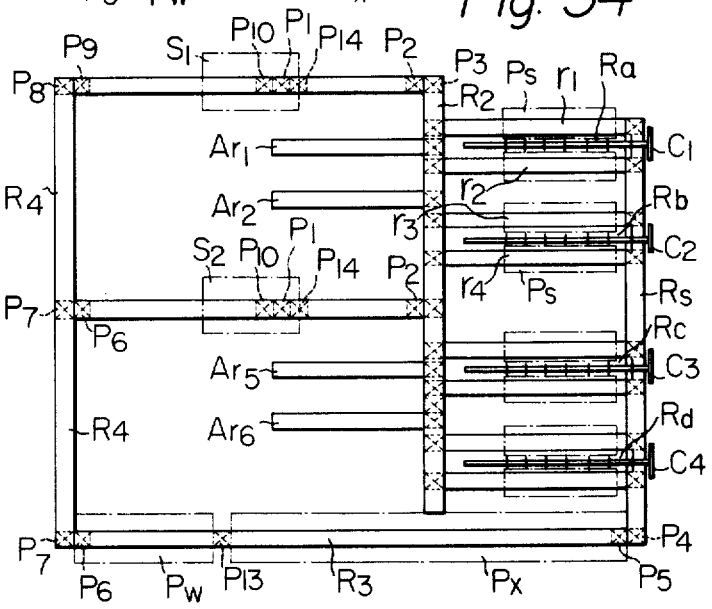

In the fifth modified system shown in FIG. 34, a pair of spinning devices $S_1$ and $S_2$ are utilized. Since four pairs of branched passages Ra, Rb, Rc and Rd are utilized, the carrying capacity of the first transversal passage $R_2$ becomes insufficient to carry out the operation. Consequently, the third transversal passage $R_5$ is utilized only for transporting the empty cans 8 from the branched passages Ra, Rb, Rc and Rd to the third main passage $R_3$, while the first transversal passage $R_2$ is used only for supplying a full packaged can 8 to the branched passage Ra, Rb, Rc and Rd. Consequently, a combined transportation equipment comprising a main carrier 13 and an auxiliary carrier 15 shown in FIGS. 14 and 15 is utilized for the third transversal passage $R_5$.

In the sixth modified system shown in FIG. 35, four branched passages Rb are utilized for every creel $C_1$ ($C_2$). According to our experience, in the case of producing fine filaments, a large number of full packaged cans 8 are required to supply the material to a drawing equipment. However, since the space for creeling is restricted to a certain area, the above-mentioned creeling system is preferable. In this embodiment, the reserving passage $Ar_3$, $Ar_4$, $Ar_7$ and $Ar_8$ which are similar to the reserving passage $Ar_3$ and $Ar_4$ of the second modified system shown in FIG. 31, and the second and third transversal passages $R_2$ and $R_5$ utilized in the fifth modified system shown in FIG. 34, and double passages $AR_3$ and $BR_3$ utilized in the fourth modified system shown in FIG. 33, are applied. If it is necessary to use a large number of full packaged cans at a drawing equipment, more than four branched passages Ra may be utilized.

In the seventh modified system shown in FIG. 36, which is quite similar to the first embodiment shown in FIG. 1, an additional passage $R_6$ is formed so as to carry full packaged cans which contain waste material melt spun at the time of starting the spinning operation, to a discharge position Pd. A carrier 103 shown in FIG. 25 is preferably utilized for the passage $R_6$. In this drawing, $P_{22}$ represents a connextion between the first transversal passage $R_2$ and the additional passage $R_6$.

In the above-mentioned modified systems, the motion of the carriers along the first and third main passages, the main carriers along the first, second and third transversal passages, the auxiliary carrier along the first and third main passages and other passages branching from the first, second and third transversal passages are carried out in a manner quite similar to the first embodiment.

While the invention has been described in conjunction with certain embodiments thereof it is to be understood that various modifications and changes may be made without departing from the spirit and scope of the present invention.

What we claim is:

1. In a textile factory provided with at least one spinning equipment for producing an undrawn filament-bundle and at least one drawing equipment for drawing said undrawn filament bundle, said spinning equipment provided with a delivering mechanism for depositing said undrawn filament bundles in cans and said drawing equipment provided with a creel extended outward therefrom for removing said filament bundles from said cans, a system of transporting said filament bundle by said cans, a cans carrying passage formed on a base floor wherein each drawing equipment is installed, said cans carrying passage formed on said base floor comprising a first passage for transporting full packaged cans filled with said filament bundle from a first position below said delivering mechanism to a second position, and at least one branched passage connected to said first passage and arranged at a position adjacent to said creel in paralleled condition to said extended creel, and a second passage for transporting empty cans from said branched passage to an upstream terminal of said first passage, a system of transporting said filament bundle by cans, comprising means for carrying said cans along said cans carrying passage at predetermined positions, means for stopping said cans carrying means at any of said predetermined positions, each of said first and second passages being provided with apparatus carrying means, said cans carrying means being provided with a combined transporting equipment comprising a main carrier being capable of moving in either of two directions along said first and second passages toward either one of said upstream and downstream terminals thereof and an auxiliary carrier capable of being positioned on said main carrier in either of the first and second passages and capable of moving along said first and second main passages and said branched passage, each said auxiliary carrier being provided with a lifting member for supporting a can above said base floor and for positioning said can on said base floor according to upward or downward displacement thereof, and means for aligning a plurality of said auxiliary carriers along said branched passage for retaining said auxiliary carriers in said aligned position, cans thereon are emptied by said creel, and for moving said aligned auxiliary carriers back to said first main passage with said empty cans.

2. A system of transporting filament-bundles according to claim 1, wherein said auxiliary carrier is provided with a base frame which is provided with plural pairs of wheels, and also provided with a reversible motor for driving a pair of said wheels in normal and reverse directions and a control means for actuating said lifting member, said lifting member comprising a lifting table and a mechanism for displacing said lifting table to uppermost and lowermost positions thereof, whereby said lifting table is capable of supporting a can at a position above said base floor when said table is positioned at said uppermost position and said carrier is capable of displacing said can to a position above any predetermined position on said base floor along said carrying passage in a condition supported by said lifting tables, and said can is positioned on said predetermined position by displacing said lifting table to its lowermost position where said table is free from said can.

3. A system of transporting a filament-bundle according to claim 1, wherein said first passage and second passage are connected to each other so that a closed passage is formed and said branched passage is branched from said closed passage, said closed passage being formed with first and second main passages arranged in a parallel condition to each other and first and second transversal passages connected to said main passages in such a way that an upstream terminal of said first main passage and a downstream passage of said second main passage are connected to a downstream and an upstream terminal of said first transversal passage, respectively, a downstream terminal of said first main passage and an upstream terminal of said second main passage are connected to an upstream terminal of said second transversal passage and a downstream terminal of said second transversal passage, respectively, said first main passage being formed at a position below said delivering mechanism of said spinning equipment, each said branched passage is branched from said first transversal passage in straight condition.

* * * * *